US008109378B2

(12) United States Patent
Boydston et al.

(10) Patent No.: US 8,109,378 B2
(45) **Date of Patent: *Feb. 7, 2012**

(54) BOTTLED WATER DISTRIBUTION METHOD AND BOTTLE RETURN APPARATUS

(75) Inventors: Brent C. Boydston, Winston-Salem, NC (US); Douglas A. Fullerton, Winston-Salem, NC (US); Michael S. Gunter, Winston-Salem, NC (US); Billy D. Prim, Winston-Salem, NC (US); Robert C. Wiles, Winston-Salem, NC (US)

(73) Assignee: Primo Water Corporation, Winston-Salem, NC (US)

( * ) Notice: Subject to any disclaimer, the term of this patent is extended or adjusted under 35 U.S.C. 154(b) by 58 days.

This patent is subject to a terminal disclaimer.

(21) Appl. No.: 11/481,268

(22) Filed: Jul. 5, 2006

(65) Prior Publication Data

US 2007/0012541 A1 Jan. 18, 2007

Related U.S. Application Data

(60) Provisional application No. 60/699,235, filed on Jul. 14, 2005.

(51) Int. Cl.
*G07F 7/00* (2006.01)

(52) U.S. Cl. ..... 194/205; 194/211; 220/485; 220/494; 220/495

(58) Field of Classification Search ..... 194/205, 194/208–213, 334, 335, 338; 209/539, 579, 209/635, 655, 698, 919, 924, 933; 241/36, 241/81, 99, 100; 356/42, 72, 73; 220/485–495; 232/47

See application file for complete search history.

(56) References Cited

U.S. PATENT DOCUMENTS

| | | | | |
|---|---|---|---|---|
| 969,879 A | | 9/1910 | Karlson | |
| 1,995,779 A | * | 3/1935 | Pencovie | 220/262 |
| 2,931,535 A | * | 4/1960 | Lockwood | 206/507 |
| 2,954,111 A | | 9/1960 | Garrard | |
| 3,009,674 A | | 11/1961 | Ingvartsen | 248/120 |
| 3,288,484 A | | 11/1966 | Brunette | |

(Continued)

FOREIGN PATENT DOCUMENTS

DE 297 06 654 U1 10/1997

(Continued)

OTHER PUBLICATIONS

First Translation of KR615797B1.*

(Continued)

*Primary Examiner* — Jeffrey Shapiro
(74) *Attorney, Agent, or Firm* — K&L Gates LLP

(57) ABSTRACT

Method and apparatus for bottled beverage distribution. Apparatus includes bin, means for receiving bottles, sensor and receipt dispenser. Method of selling includes providing an inventory, assigning identification indicia, assigning first and second purchase prices and positioning apparatus for receiving, storing and dispensing receipt. Method of distributing includes delivering to a first location water bottles, positioning at a second location a receiving, storing and receipt dispensing apparatus, and retrieving empty bottles from the apparatus. Method of distributing includes creating an account, assigning a first amount charged for each bottle sold, assigning a second amount deducted from the first amount for each bottle received, delivering bottles and positioning a receiving, storing and receipt dispensing apparatus. Method of distributing includes delivering inventory of drinking water, transferring ownership of the inventory, invoicing for each bottle delivered and retrieving empty drinking water bottles from bottle return apparatus.

51 Claims, 16 Drawing Sheets

U.S. PATENT DOCUMENTS

| | | | | | |
|---|---|---|---|---|---|
| D223,956 | S | | 6/1972 | Kenerson | 49/35 |
| 3,973,237 | A | | 8/1976 | Sawaguchi et al. | |
| 4,013,292 | A | | 3/1977 | Cohen et al. | |
| 4,090,633 | A | * | 5/1978 | Trubiano | 220/6 |
| 4,207,973 | A | | 6/1980 | Stampleman | 194/4 F |
| 4,245,731 | A | * | 1/1981 | Herbst et al. | 194/209 |
| 4,248,334 | A | | 2/1981 | Hanley et al. | |
| 4,492,295 | A | | 1/1985 | DeWoolfson | |
| 4,532,859 | A | | 8/1985 | Solørdal | 100/35 |
| 4,573,641 | A | | 3/1986 | DeWoolfson et al. | 241/36 |
| 4,579,216 | A | * | 4/1986 | DeWoolfson et al. | 194/212 |
| 4,674,677 | A | | 6/1987 | Trautwein | |
| 4,829,428 | A | | 5/1989 | Weitzman et al. | 364/401 |
| D307,343 | S | | 4/1990 | Lauraine, Jr. et al. | 34/1 |
| 4,947,988 | A | | 8/1990 | Schutz | 206/386 |
| 4,967,045 | A | | 10/1990 | Keefer | 200/296 |
| 4,988,010 | A | | 1/1991 | Pollak | |
| D314,655 | S | | 2/1991 | Hosmer | 34/40 |
| 5,028,099 | A | | 7/1991 | Bertucco | 312/250 |
| 5,042,634 | A | | 8/1991 | Gulmini | 194/209 |
| D324,593 | S | | 3/1992 | Kouwenhoven | 34/1 |
| 5,121,778 | A | | 6/1992 | Baker et al. | 141/319 |
| 5,161,661 | A | | 11/1992 | Hammond | 194/209 |
| 5,222,531 | A | | 6/1993 | Baker et al. | 141/18 |
| 5,289,855 | A | | 3/1994 | Baker et al. | 141/18 |
| 5,295,519 | A | | 3/1994 | Baker et al. | 141/18 |
| 5,324,054 | A | | 6/1994 | Kleier | |
| D349,997 | S | | 8/1994 | Ullmann | 34/1 |
| D351,697 | S | | 10/1994 | Blotnick | D34/1 |
| 5,361,913 | A | | 11/1994 | Melchionna | 209/583 |
| D355,289 | S | | 2/1995 | Schäfer | 34/1 |
| 5,423,492 | A | | 6/1995 | Willis | |
| D361,039 | S | | 8/1995 | Rokus | D9/531 |
| 5,447,256 | A | | 9/1995 | Graham | |
| 5,465,822 | A | * | 11/1995 | DeWoolfson et al. | 194/209 |
| D377,553 | S | | 1/1997 | Cozart | 34/1 |
| 5,607,112 | A | | 3/1997 | Wilson | |
| 5,695,039 | A | * | 12/1997 | Driscoll et al. | 194/212 |
| D388,922 | S | | 1/1998 | Peters | 34/1 |
| 5,737,903 | A | | 4/1998 | Minutillo | 53/475 |
| 5,788,045 | A | | 8/1998 | Stiefel et al. | |
| D402,037 | S | | 12/1998 | Hofstad | 34/38 |
| D420,479 | S | | 2/2000 | Delmerico | 34/1 |
| 6,047,843 | A | | 4/2000 | Mecke | 220/23.88 |
| D428,229 | S | | 7/2000 | Olivetti | 34/1 |
| 6,192,296 | B1 | | 2/2001 | Colmant et al. | |
| 6,223,927 | B1 | | 5/2001 | Rand | 220/495.06 |
| 6,349,972 | B1 | | 2/2002 | Geiger et al. | |
| 6,547,055 | B2 | | 4/2003 | Coyne et al. | 194/207 |
| 6,575,290 | B2 | | 6/2003 | Löning et al. | 198/495 |
| 6,578,763 | B1 | | 6/2003 | Brown | 235/435 |
| 6,817,462 | B1 | | 11/2004 | Salda | 194/208 |
| 7,296,745 | B2 | | 11/2007 | Weisz et al. | 235/462.01 |
| 2002/0043509 | A1 | | 4/2002 | Lajeunesse et al. | |
| 2003/0042110 | A1 | * | 3/2003 | Wilfong | 194/302 |
| 2005/0073417 | A1 | | 4/2005 | Mathewson, II et al. | 340/572.1 |
| 2006/0065717 | A1 | * | 3/2006 | Hurwitz et al. | 235/381 |
| 2006/0069642 | A1 | | 3/2006 | Doran et al. | 705/39 |
| 2006/0071063 | A1 | * | 4/2006 | Duckett | 235/375 |
| 2007/0012541 | A1 | | 1/2007 | Boydston et al. | 194/205 |
| 2007/0080251 | A1 | | 4/2007 | Schwelling | |
| 2007/0090938 | A1 | | 4/2007 | Donaldson | 340/457 |
| 2007/0159308 | A1 | | 7/2007 | Johnston | 340/425.5 |
| 2008/0106089 | A1 | * | 5/2008 | Geiger et al. | 283/72 |
| 2008/0134735 | A1 | | 6/2008 | Gallo et al. | |
| 2009/0140000 | A1 | | 6/2009 | Davis, Jr. | |
| 2009/0230131 | A1 | | 9/2009 | McDuffie et al. | |

FOREIGN PATENT DOCUMENTS

| | | | |
|---|---|---|---|
| DE | 102 40 768 | A1 | 3/2004 |
| DE | 10240768 | | 3/2004 |
| KR | 615797 | B1 * | 8/2006 |

OTHER PUBLICATIONS

Second Translation of KR615797B1.*
Post Office Box.
Night Deposit Box.
Excerpts from Registration Statement of Blue Rhino Corporation.
International Search Report.
Underhill, Paco, "Why We Buy: The Science of Shopping", copyright 1999, Simon and Schuster, pp. 200-211.

* cited by examiner

BOTTLED WATER DISTRIBUTION METHOD AND BOTTLE RETURN APPARATUS

CROSS-REFERENCE TO RELATED APPLICATIONS

This application is entitled to the benefit of, and claims priority to, provisional U.S. Patent Application Ser. No. 60/699,235 filed on Jul. 14, 2005, the entirety of which is incorporated herein by reference.

FIELD

1. Technical Field

The present invention relates to the field of beverage distribution and particularly to a new method and apparatus used in the distribution of bottled beverages such as bottled drinking water.

2. Background Information

Many residential and commercial water cooler devices use bottles of drinking water that contain at least one gallon—and often several gallons—of drinking water. Unless otherwise explicitly indicated, the terms "bottles," "bottled drinking water" and the like are used herein to refer to drinking water bottles intended for use with water cooler devices. Two such drinking water bottles are the three-gallon and five-gallon sizes of the bottle disclosed in U.S. Design Pat. No. 361,039.

As those of skill in the art will appreciate, "water coolers" is a general term used to describe devices from which bottled drinking water is dispensed. Often, a drinking water bottle is disposed inverted on a water cooler device when in operation. Many water coolers are capable of not only cooling bottled drinking water, but also heating it as well. Thus, as used herein, the terms "water cooler," "water cooler device" and the like refer to any device from which bottled drinking water is dispensed, and not to any specific device or only to devices which in fact cool drinking water.

Typically, water bottles used with such cooler devices are not disposable and are intended for reuse. Because of this, such drinking water bottles are more sturdily constructed, and thus more expensive, than beverage bottles such as plastic soft drink bottles that are intended to be thrown away after a single use. Thus, even when empty drinking water bottles have value to a water distributor. Not only do such bottles represent a capital investment on the part of the distributor, but such bottles also represent potential sales because they can be cleaned, refilled and used multiple times.

Historically, water cooler devices were primarily used in businesses. Bottled water distributors entered into arrangements with businesses having water cooler devices. In such arrangements, a distributor would periodically deliver full bottles of drinking water to a business and retrieve empty drinking water bottles from the business. The distributor would then clean, sanitize, refill and reuse the empty bottles.

In recent years, however, the use of water cooler devices in residential settings has significantly increased. It is suspected that this increase is due, at least in part, to an increase in consumer demand for pure drinking water and to a decline in prices of water cooler devices. This increased residential demand for bottled drinking water has created a challenge for the historical bottled water distribution system. While there are now more bottled water customers, many of these customers are residential customers that do not have as high of a recurring demand for bottled water as the traditional business customers. It is thus often less economically efficient for a bottled water distributor to make home deliveries as it is for the distributor to make business deliveries.

In an attempt to address this challenge, bottled water distributors have begun entering into arrangements with retailers. In such arrangements, the bottled water distributor periodically delivers full drinking water bottles to retailers and the retailers sell full water bottles to their customers.

It should be understood that the terms "retailer" and "seller" as used herein refer to an individual, group of individuals, company or other entity that sell goods or services, regardless of whether such sales are "at retail." Similarly, the term "store" as used herein refers to any location at which sales are made, regardless of whether such location be an actual store that is open to the public.

While these retail arrangements are advantageous in that they serve the needs of residential bottled water customers in a more economically efficient manner than home deliveries, the fact that the drinking water bottles are reusable creates at least two significant problems for retailers. The first problem is that retail personnel must be used to receive and verify customer returns of empty bottles. Because customers are usually charged less for a full bottle of drinking water when they return an empty bottle, each store selling bottled water must have a way of verifying whether or not a customer buying a full bottle of drinking water has returned an empty bottle. In known distribution methods, one of the retailer's employees is used to manually receive each empty drinking water bottle returned by a customer. This means that such employee must temporarily stop what he or she is doing when a customer returns an empty drinking water bottle.

A second significant problem created for retailers in known methods of distributing bottled drinking water is that the retailer must financially manage deposit amounts. Because empty drinking water bottles have value to distributors, bottled water distributors often charge retailers a deposit for each bottle of drinking water delivered to the retailer to ensure that the distributor gets empty bottles back from the retailer or is made whole for the loss of bottles that are not returned. Retailers typically pass the deposit amounts on to their customers. The result of the deposit system is that retailers are forced to carry the deposit amounts on their financial books, give refunds to customers when empty bottles are returned but full bottles are not purchased, and reconcile deposit amounts with bottled water distributors.

The necessity of using store personnel to verify and receive empty bottles returned from customers and the burden of managing deposit amounts create significant deterrents to wide-spread adoption of retail bottled water distribution arrangements.

What is needed in the art is a new way of distributing bottled drinking water using retailers that will not burden retail personnel with additional obligations such as receiving empty bottles returned by customers and managing deposit amounts.

SUMMARY

The present invention overcomes the disadvantage of having to use store personnel to verify and receive empty bottles returned from customers and the burden of managing deposit amounts by providing a new bottle return apparatus and new methods of selling and distributing bottled drinking water.

A drinking water bottle return apparatus includes a bin capable of holding empty bottles, a door allowing for removal of empty bottles, means for receiving bottles into the bin, a sensor to detect bottles received into the bin and a receipt dispenser that dispenses a receipt in response to detection by the sensor of a bottle received into the bin. A bottle deposited into the empty bin falls by gravity until stopped by the bottom of the bin and is detected by the sensor, which causes the receipt dispenser to dispense a receipt for the bottle. One or more circulation openings may be provided to allow air outside of the bin to circulate among bottles in the bin. Means for receiving bottles into the bin may include a receiving chute or a rotatably mounted receiving tray. The means for receiving bottles into the bin may have a size and shape such that only one bottle at a time can be received into the bin. The sensor may detect a bottle as it passes through the means for receiving bottles into the bin. The sensor may detect a bottle as it falls by gravity in the interior of the bin. The sensor may be a mechanical, electro optical, RFID or other device. Receipts dispensed by the apparatus may by include a universal product code, stock keeping unit or other product identifying information. Receipts dispensed by the apparatus may include an RFID tag. The door, receipt dispenser and receiving means may be accessible from the same side of the bin, as may be a circulation opening.

A method of selling bottled drinking water includes providing at a first location an inventory of bottled drinking water for sale, assigning product identification information to each bottle in the inventory, assigning a first purchase price to each bottle in the inventory that will be charged to a purchaser of a bottle from the inventory that does not return an empty bottle, assigning a second purchase price to each bottle in the inventory that will be charged to a purchaser of a bottle from the inventory that does return an empty bottle, and positioning at a second location an apparatus capable of receiving and storing empty water bottles from the inventory without damaging the empty bottles and dispensing a receipt having assigned product identification information in response to each empty bottle deposited in the apparatus. A purchaser of a bottle of drinking water from the inventory can thus deposit an empty drinking water bottle in the apparatus, receive a receipt from the apparatus and then present the receipt with the product identification information upon purchase of a full bottle and be charged the second purchase price. The second purchase price may be lower than the first purchase price. The first location may be inside of a store and the second location may be inside or outside of the same store. The first location may be a store that also sells water cooler devices. Product identification information may include a universal product code, a stock keeping unit number or any other suitable information. The product identification information may be encoded on an RFID tag on each bottle. The seller may of bottled drinking water may or may not own the inventory of bottled water and may or may not own the apparatus.

The inventory may include drinking water in bottles of more than one size. Different product identification information may be assigned to each size of bottle in the inventory and the apparatus may be capable of receiving and storing each size of bottle without damaging such bottle and dispensing in response to each bottle deposited in the apparatus a receipt having product identification information assigned to each size of bottle. Product identification information assigned to each bottle of drinking water in the inventory may be encoded on an RFID tag on each bottle. The first purchase price assigned to a size of drinking water bottle in the inventory may differ from the first purchase price assigned to a different size of drinking water bottle in the inventory. The second purchase price assigned to a size of drinking water bottle in the inventory may differ from the second purchase price assigned to a different size of drinking water bottle in the inventory.

A method of distributing bottled drinking water may include delivering at a predetermined time to a first location full drinking water bottles for display and sale, positioning at a second location an apparatus capable of receiving and storing bottles without damaging such bottles and dispensing in response to each bottle deposited in the apparatus a receipt having product identification information, retrieving from the apparatus at a time later than the predetermined time bottles contained in the apparatus and delivering to the first location an additional plurality of full drinking water bottles for display and sale. A customer can thus purchase a bottle of drinking water at the first predetermined location and after consuming all water in such bottle deposit the empty bottle at the second predetermined location and receive a receipt evidencing such deposit. The bottles may be delivered to the first location on consignment. The first location may be inside a store and the second location may be inside or outside of the same store. Water cooler devices may also be sold at the first location.

A method of distributing bottled drinking water may include creating an account for a store operator that will sell drinking water bottles, assigning a first amount to be charged to such account for each bottle of drinking water sold by the operator, assigning a second amount that will be deducted from the first amount for each empty bottle received from the store operator, delivering to the store operator drinking water bottles for display and sale by the operator, positioning an apparatus capable of receiving and storing empty bottles without damaging the bottles and dispensing in response to each empty bottle deposited in the apparatus a receipt having product identification information, later retrieving empty bottles from the apparatus and determining the number of full water bottles that have been sold by the store operator, and invoicing the store operator an amount equal to the first amount multiplied by the number of drinking water bottles that have been sold by the store operator since the predetermined time minus the second amount multiplied by the number of empty bottles retrieved from the apparatus. A store operator can thus sell bottled drinking water and collect empty bottles without managing deposit amounts and without using a store employee to receive empty bottles deposited at the store.

A method of distributing bottled drinking water may include delivering an inventory of full drinking water bottles to a retailer for display and sale at a location, transferring ownership of the inventory to the retailer at the time that the inventory is delivered, invoicing the retailer a predetermined amount for each full drinking water bottle delivered to the retailer, and retrieving at least one empty drinking water bottle from a bottle return apparatus at the predetermined location that has a receipt dispenser for automatically dispensing a receipt in response to each empty drinking water bottle deposited in the apparatus. A retailer can thus ascertain without otherwise interfacing with the customer that the customer has deposited an empty drinking water bottle in the bottle return apparatus. The receipt may have product identification information corresponding to the drinking water bottle deposited in the apparatus. A customer having an empty drinking water bottle can thus deposit an empty drinking water bottle in the bottle return apparatus and receive a receipt from such apparatus for use in a subsequent purchase of a full drinking water bottle.

BRIEF DESCRIPTION OF THE DRAWINGS

For a more complete understanding of this invention reference should now be had to the preferred embodiments illustrated in greater detail in the accompanying drawings and described below. In the drawings, which are not to scale.

DESCRIPTION

The present invention will now be described fully hereinafter with reference to the accompanying drawings, in which preferred embodiments of the invention are shown. This invention may, however, be embodied in many different forms and should not be construed as limited to the preferred embodiments set forth herein. Rather, these preferred embodiments are provided so that this disclosure will be thorough and complete, and will fully convey the scope of the invention to those skilled in the art. It will be understood that all alternatives, modifications, and equivalents are intended to be included within the spirit and scope of the invention as defined by the appended claims.

The present invention solves problems created for retailers by previous bottled water distribution systems by providing a new empty bottle return apparatus, a new bottled water distribution method and a new method of selling bottled water products. The apparatus of the present invention receives empty bottles being returned, issues a receipt therefore and stores a plurality of empty bottles until they are retrieved by a bottled water distributor. Thus, the present invention allows a retailer to sell bottled water without the need to use store personnel for receiving and storing empty bottles returned to the store by its customers.

Figure 1:
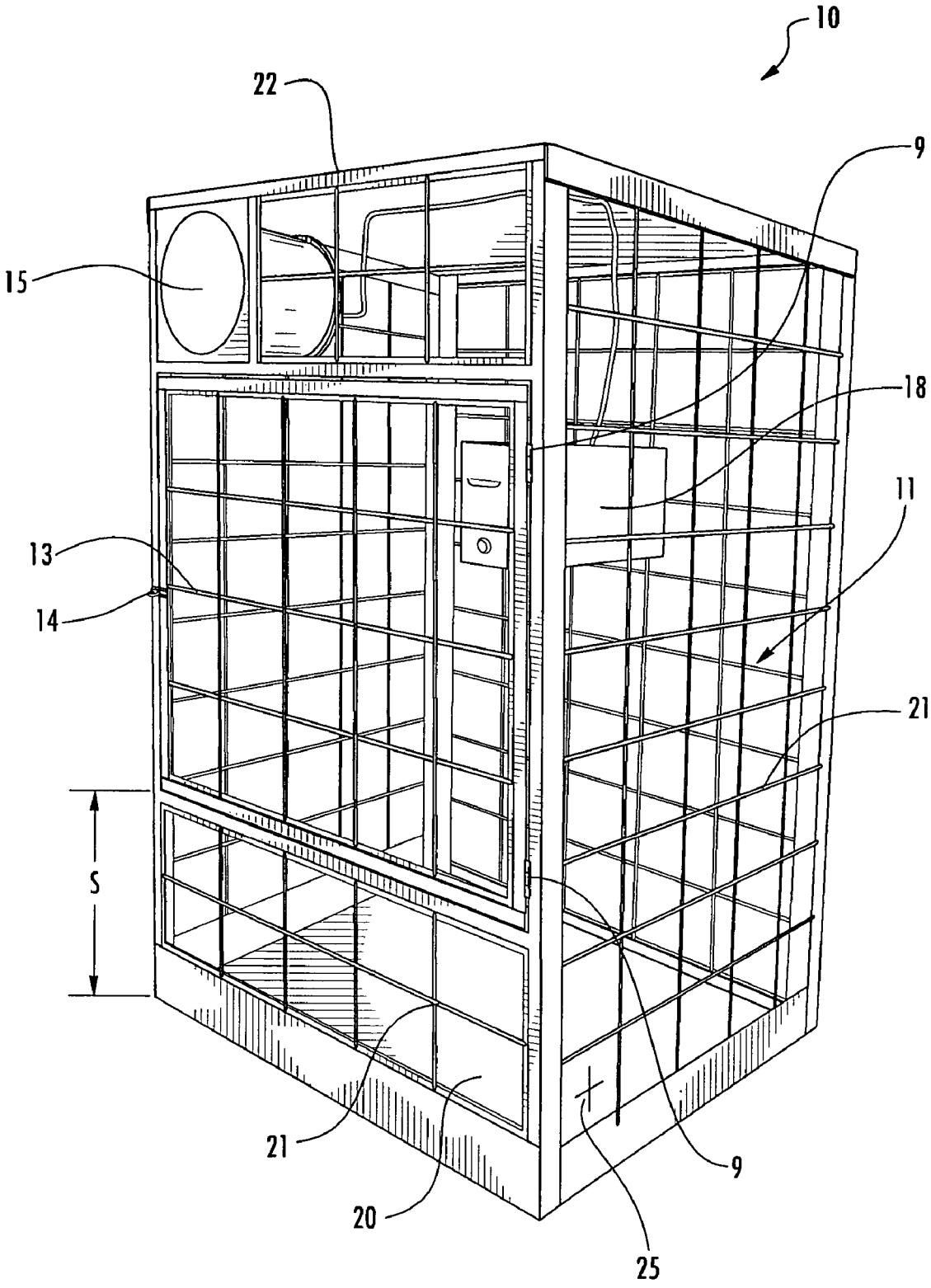
FIG. 1 is a perspective view of a bottle return apparatus in accordance with a preferred embodiment of the present invention.
Figure 2:
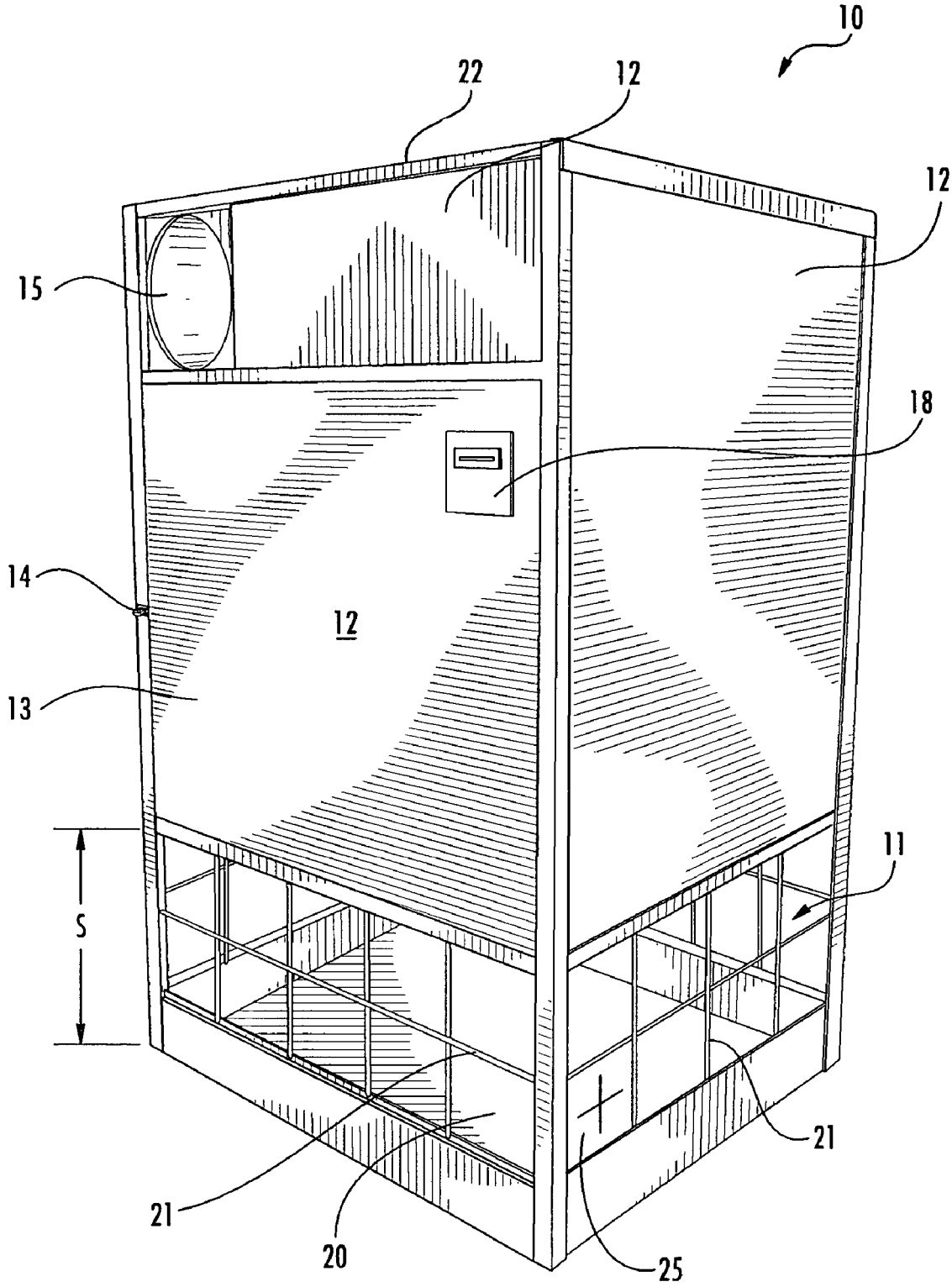
FIG. 2 is a perspective view of a preferred embodiment of the bottle return apparatus of FIG. 1 in which panels are affixed to the bottle return apparatus.
Figure 3:
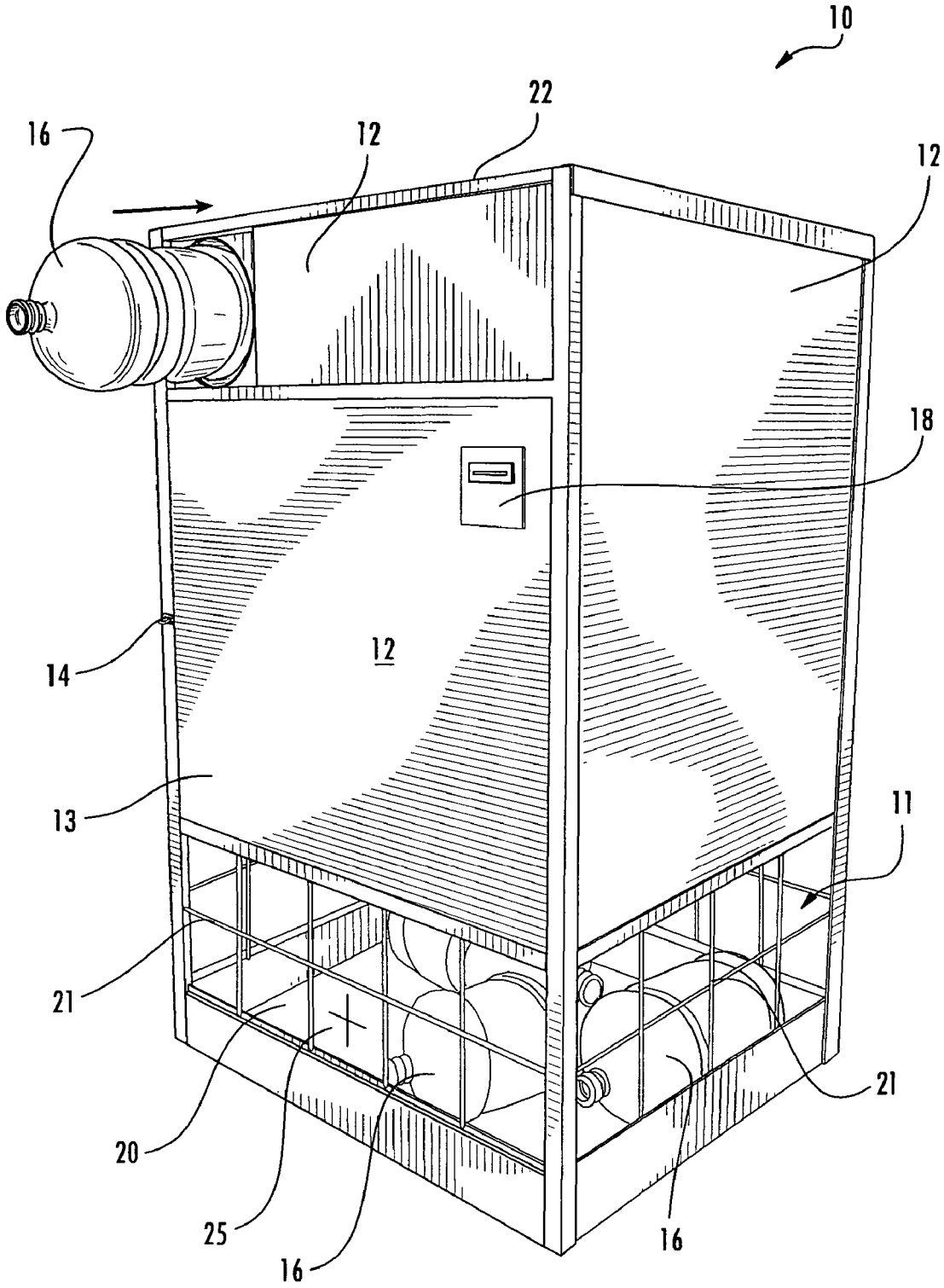
FIG. 3 is a perspective view of the bottle return apparatus of FIG. 2 illustrating the receipt of an empty bottle into the apparatus.
Figure 4:
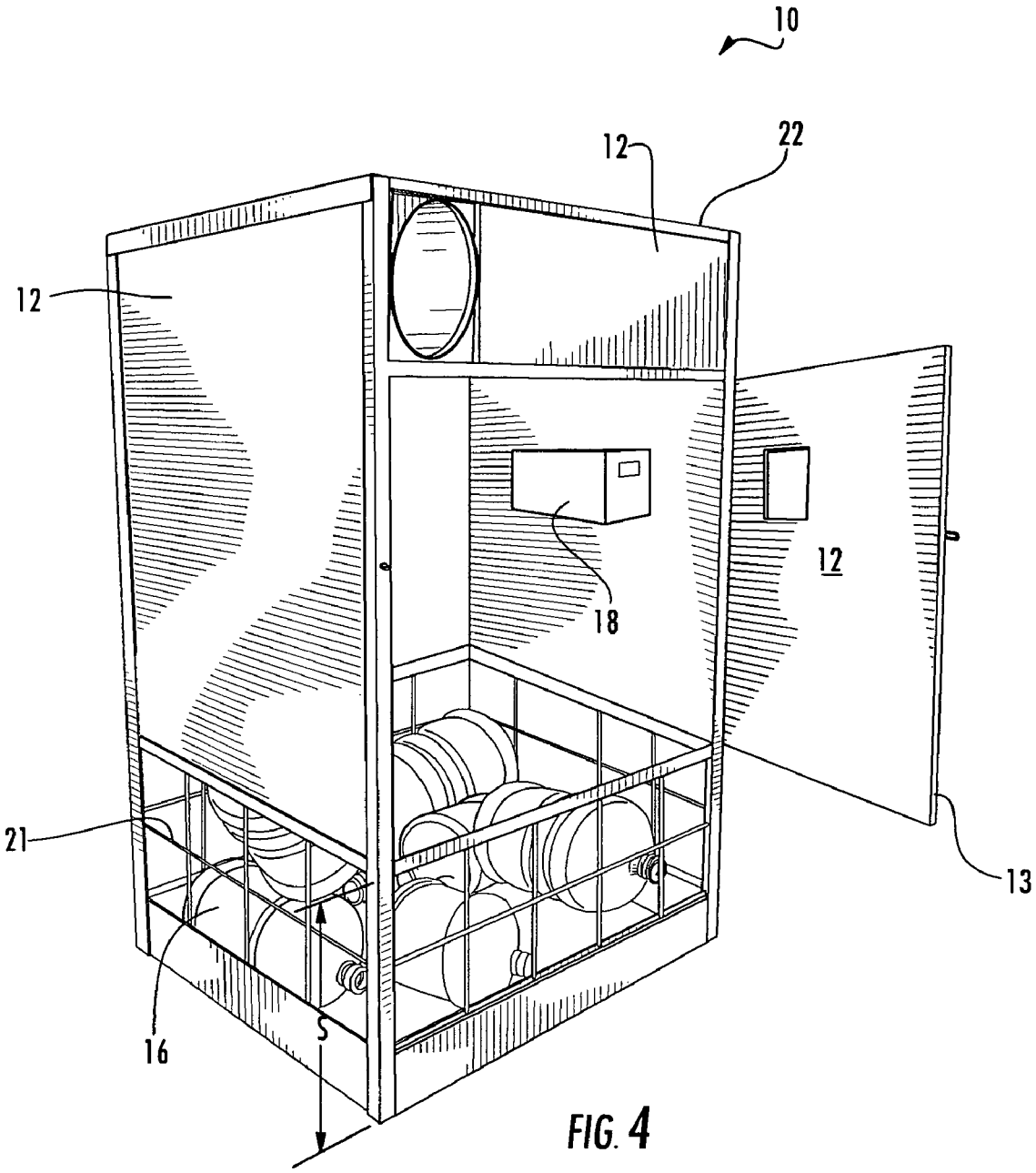
FIG. 4 is a perspective view of the bottle return apparatus of FIG. 2 with the door open.

A preferred embodiment of a return apparatus according to the present invention is depicted in FIGS. 1-10. Turning now to FIGS. 1-3, a bottle return apparatus 10 has a bin 11 that is capable of holding a plurality of empty drinking water bottles. As those in the art will appreciate, the size of the bin 11 may be selected based upon considerations such as space limitations in the desired bin location, the size of empty bottles desired to be deposited in the bin, the anticipated or actual rate of bottle return in the location of the bin, the anticipated or actual time between pick-ups of empty water bottles from the bin 11, the desired number of empty water bottles that will be stored in the bin 11 and the desired method of transporting the apparatus. Advantageously, the shape or "footprint" of the apparatus 10 may be designed such that it is suitable for movement on a standard pallet.

The bin 11 has a plurality of walls 21 and a top 22. The bin 11, walls 21 and top 22 may be composed of any suitable materials. If the apparatus is intended to be placed outdoors, then the materials used to construct the bin 11, and particularly the walls 21 and top 22, should be suitable weather-resistant materials. For example, the walls 21 and top 22 may be composed of wire or steel mesh material. In addition, the walls 21 and top 22 may be composed of a solid material. In a preferred embodiment, illustrated in FIGS. 1-3, the bin 11 has four walls 21. A suitable bin 11 in accordance a preferred embodiment of the present invention may be constructed using a top 22 fabricated from 22 gauge steel and walls 21 fabricated from 16 gauge steel and 0.207 inch diameter steel rods.

The bin 11 has at least one door 13 that is movable between a closed position (illustrated in FIGS. 1-3) that retains empty water bottles 16 in the interior of the bin 11, and an open position (illustrated in FIG. 4) that allows access to the interior of the bin 11 for removal of empty water bottles 16 inside the bin 11. The door 13 may be affixed to the bin 11 by any suitable means. In a preferred embodiment, depicted in FIG. 1, the door is connected to the bin 11 by hinges 9 so that the door 13 swings outward and away from the bin 11 to permit access to the contents of the bin 11.

The door 13 may be any desired shape and size, provided that the shape and size of the door permit removal of empty bottles 16 within the bin 11 through the door 13 when the door is open. A latch 14 may be used to hold the door 13 in the closed position. The latch 14 may also be used in conjunction with a padlock or other locking mechanism (not illustrated) for securing the door 13 in the closed position. A spring mechanism, or other known devices, may be used to keep the door biased in the closed position.

While only a single door has been illustrated in the present application, those in the art will appreciate that more than one door may be used, including the use of so-called "French doors." Moreover, while a generally square door has been illustrated, those in the art will appreciate that the door may be any suitable shape.

Advantageously, the door 13 may be spaced from the bottom of the bin 11 by a suitable distance S (see FIGS. 1, 2 and 4) to retain at least a portion of the empty bottles 16 within the bin 11 when the door 13 is in the open position.

The bottom 20 of the apparatus 10 may be constructed of any suitable material. Preferably, the bottom 20 should be a material that will not cause bottle breakage or damage when a bottle 16 impacts the bottom 20 upon being deposited in the bin 11. It should be noted that as used herein, "bottom" means the surface upon the first empty bottle 16 deposited in the bin 11 comes to rest. The bottom 20 may be a structural member that is connected to one or more of the walls 21. Alternatively, the bottom 20 need not be connected to the bin 11. For example, the bottom 20 may be the ground, pallet or other surface upon which the apparatus 10 is positioned. Alternatively, the bottom 20 may be a cushioning or protective material (such as foam or rubber padding) that is positioned inside the apparatus. The bottom 20 may be a water-absorbent material, which may be advantageously used if the apparatus is located indoors. The bottom 20 may be a non water-absorbent material, which may be advantageously used if the apparatus is located outdoors where water absorption by the bottom would facilitate mold formation or other undesirable conditions. The bottom 20 may be a so-called "closed cell" material.

As depicted in FIGS. 2, 3, 4, 9 and 16, panels 12 may be affixed to the walls 21 and door 13 of the bin 11. Advertisements, instructions, decorative graphics text or the like may adorn the outside of the panels 12 or walls 21. If panels 12 are affixed to the walls 21, or if solid materials are used for the walls 21 and the top 22, consideration should be given to selecting materials that can satisfactorily withstand the anticipated weather conditions if the bin 11 is to be located outdoors. It may also be advantageous to select a material capable of shielding empty bottles contained within the bin 11 from exposure to excess sunlight if the bottles are made from a material (such as some forms of polycarbonate) that suffers degradation or discoloration from prolonged exposure to sunlight.

Various means may be used for receiving empty bottles 16 into the bin 11. One such means that may be advantageously used, which is illustrated in FIGS. 1-9, is a receiving chute. A receiving chute 15 provides an opening from the exterior of the bin 11 into the interior of the bin 11 so as to permit a empty bottle 16 traveling through the receiving chute 15 to enter the bin 11. The receiving chute 15 may be spaced higher in the vertical direction than the bottom 20 so as to allow empty bottles 16 traveling there through to drop by gravity to the bottom 20. All or a portion of the receiving chute 15 may, but need not necessarily, extend outwardly (i.e., in a direction away from the interior of the bin 11) from a wall 21 of the apparatus 10. All or a portion of the receiving chute 15 may, but need not necessarily, extend inwardly (i.e., in a direction toward the interior of the bin 11) from a wall 21 of the apparatus 10. Extending at least a portion of the receiving chute 15 for a predetermined distance into the interior space of the bin 11 may be used to ensure accurate positioning of empty bottles inserted into the bin 11 relative to the sensor (discussed below).

In determining the size and shape of the receiving chute 15, it is useful to consider the size, shape and dimensions of bottles intended to be deposited in the apparatus. As used herein, the term "bottle of predetermined size" means a bottle of the type, and having the shape, size and dimensions, that is intended to be deposited in the apparatus. The receiving chute 15 may, but need not necessarily, be designed to ensure that empty bottles of predetermined size can only be inserted into the apparatus 10 in one orientation. The shape and length of the receiving chute 15 may, but need not necessarily, be designed to ensure that only one bottle of predetermined size at a time can be inserted into the apparatus. The receiving chute 15 may be positioned high enough in the vertical direction so as to allow a desired number of empty bottles 16 to be received and stored in the bin 11.

Figure 7:
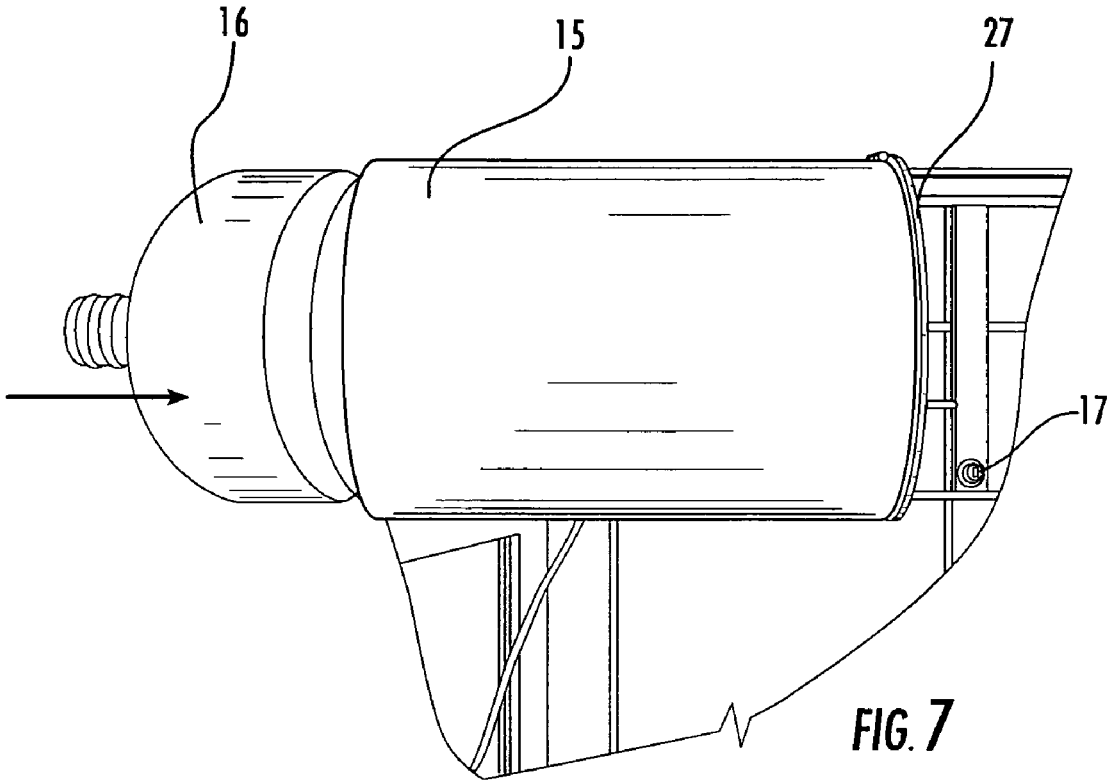
FIGS. 7 and 8 are cutaway elevation views illustrating the receipt of an empty bottle into the apparatus of FIG. 1 and the detection of the empty bottle by the sensor.
Figure 8:
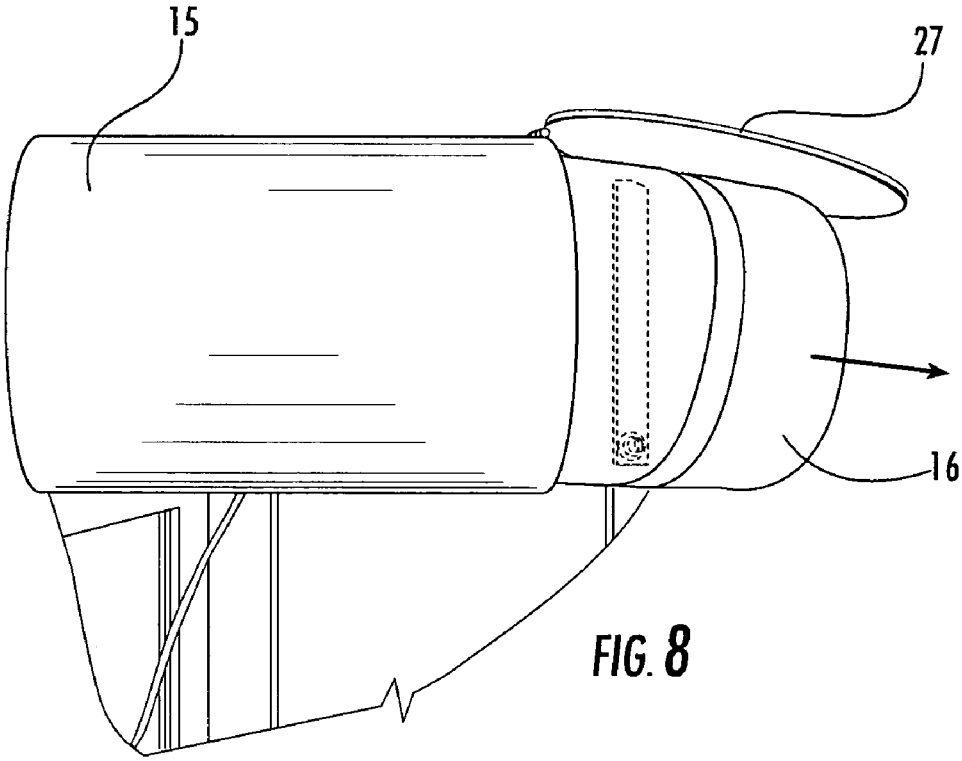

FIGS. 3, 7 and 8 illustrate the insertion of a bottle 16 into the apparatus through a generally cylindrical receiving chute 15. In these illustrations, the receiving chute 15 is sized and configured such that empty bottles 16 are permitted to pass through the receiving chute 15 only in the bottle's longitudinal direction. If it is desired that the apparatus 10 be used to collect and store generally cylindrical bottles and that such bottles be received into the apparatus only in the longitudinal direction, then the diameter of the receiving chute should be selected such that it is greater than the diameter of the bottles of predetermined size but less than the length of such bottles.

It has been found that three gallon and five gallon sized bottles of the type disclosed in U.S. Design Pat. No. 361,039 and manufactured by Reid Plastics, Inc. may be advantageously used with the present invention. When such bottles are used, a receiving chute 15 having a diameter of between ten inches and eleven inches and a length of between twelve inches and twenty-six inches may be advantageously used. Suitable three gallon and five gallon sized bottles may also be obtained from a variety of other manufacturers, including Grief, Inc. and Consolidated Container Corporation.

As illustrated in FIGS. 7 and 8, a moveable flap 27 may be used to cover an opening of the receiving chute 15. FIGS. 7 and 8 depict a movable flap 27 covering the opening of the receiving chute 15 in the interior of the bin 11. A movable flap 27 may also be used to cover the other opening of the receiving chute 15 (i.e., the first opening of the receiving chute 15 that a bottle 16 encounters when being inserted into the bin 11). A movable flap 27 may also be used to cover both openings of the receiving chute 15. Positioning a movable flap 27 over the exterior opening of the receiving chute 15 may require that person depositing a bottle into the apparatus manually open such flap 27 in order to access the opening of the receiving chute 15.

The movable flap 27 may be made from any suitable material and may be made from the same material as the receiving chute 15. As those skilled in the art will appreciate, there are many ways to attach a flap 27 to a receiving chute 15 in a way that will permit the flap 27 to move and allow a bottle 16 to travel completely through the receiving chute 15. Such mechanisms include, but are not limited to, hinge mechanisms, spring mechanisms, rotating mechanisms, and the like. For example, the flap 27 may be attached by a hinge as illustrated in FIG. 8. The flap 27 is thus permitted to swing between a closed position (illustrated in FIG. 7) wherein the flap 27 rests against the receiving chute 15 and an open position (illustrated in FIG. 8) permitting empty bottles 16 to travel completely through the receiving chute 15 and into the bin 11. The moveable flap 27 may be configured to move from the closed position to the open position by the force of a bottle 16 being inserted through the receiving chute 15 (illustrated in FIG. 8).

Presuming that the receiving chute 15 is spaced in the vertical direction from the bottom 20, an empty bottle 16 passing completely through the receiving chute 15 falls to the bottom 20 by gravity. Thereafter, the movable flap 27 returns to the closed position.

As illustrated in FIGS. 5-8, a sensor 17 detects bottles 16 entering the bin 11. The sensor 17 may be any sensor capable of detecting the presence of an object such as a bottle and may, for example, be a mechanical, electrical, magnetic or optical sensor, all of which are known to those in the art. The sensor 17 may also be a Radio Frequency Identification ("RFID") reader or other device capable of detecting the presence of RFID tags or so-called "smart labels" on water bottles entering the apparatus.

One manual sensor suitable for use in the present invention is a general purpose limit switch, such as the limit switch manufactured by Honeywell International, Inc. and designated as manufacturer part number SZL-VL-F. One optical sensor suitable for use in the present invention is a photoelectric proximity detector, such as the photoelectric proximity detector manufactured by SICK, Inc. and designated as manufacturer part number ET 1-N122.

The sensor 17 is located such that an empty bottle 16 entering the bin 11 is detected. The sensor 17 may, for example, be located inside the receiving chute 15. Alternatively, the sensor 17 may be positioned in the bin 11 at such a location that a bottle 16 contacts a mechanical sensor or passes through the field of view of an optical sensor upon entering the bin 11. The sensor 17 may also be positioned such that an empty bottle 16 having passed through the receiving chute 15 is detected by the sensor 17 as the bottle 16 falls by gravity into the interior of the bin 11.

If the sensor 17 used is a device capable of detecting an RFID tag on a bottle being deposited in the bin 11, consideration should be given to ensuring that the presence of one or more RFID tags on bottles already contained within the bin does not interfere with the detection of an RFID tag on a bottle that is being deposited into the bin. For example, such a sensor could be positioned such that RFID tags on empty bottles being deposited into the bin 11 are within the field of view of the sensor 17 but RFID tags on empty bottles having been previously deposited into the bin 11 are not within the field of view of the sensor 17.

FIGS. 5-8 illustrate an advantageous placement of an optical sensor. The sensor 17 is positioned in the bin 11 on the interior side of a wall 21 near the interior opening of the receiving chute 15 such that a bottle 16 exiting the receiving chute 15 is detected by the sensor 17.

Figure 5:
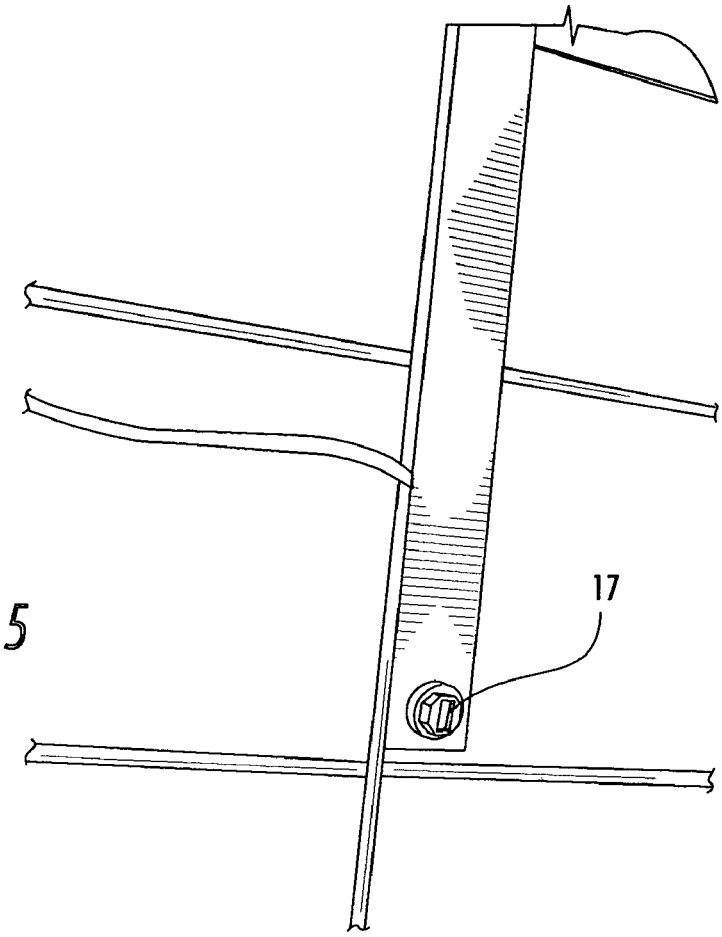
FIG. 5 is a cutaway elevation view of a sensor of the bottle return apparatus of FIG. 1.
Figure 6:
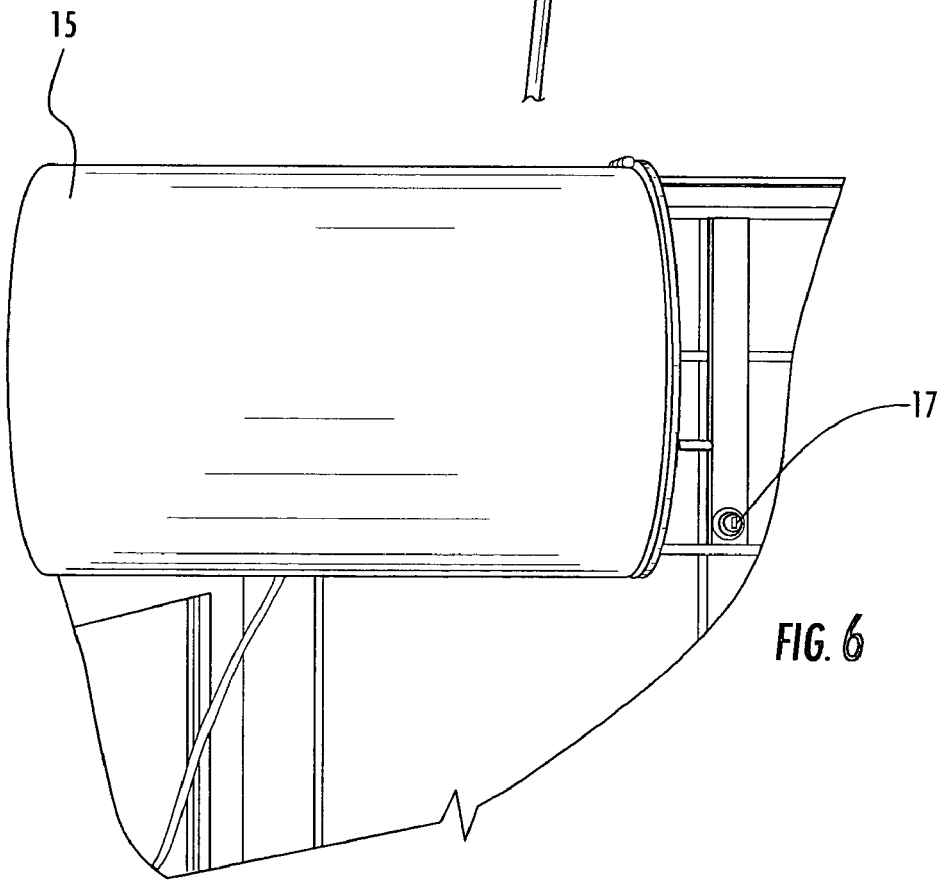
FIG. 6 is a cutaway elevation view of the receiving chute and sensor of the bottle return apparatus of FIG. 1.
Figure 10:
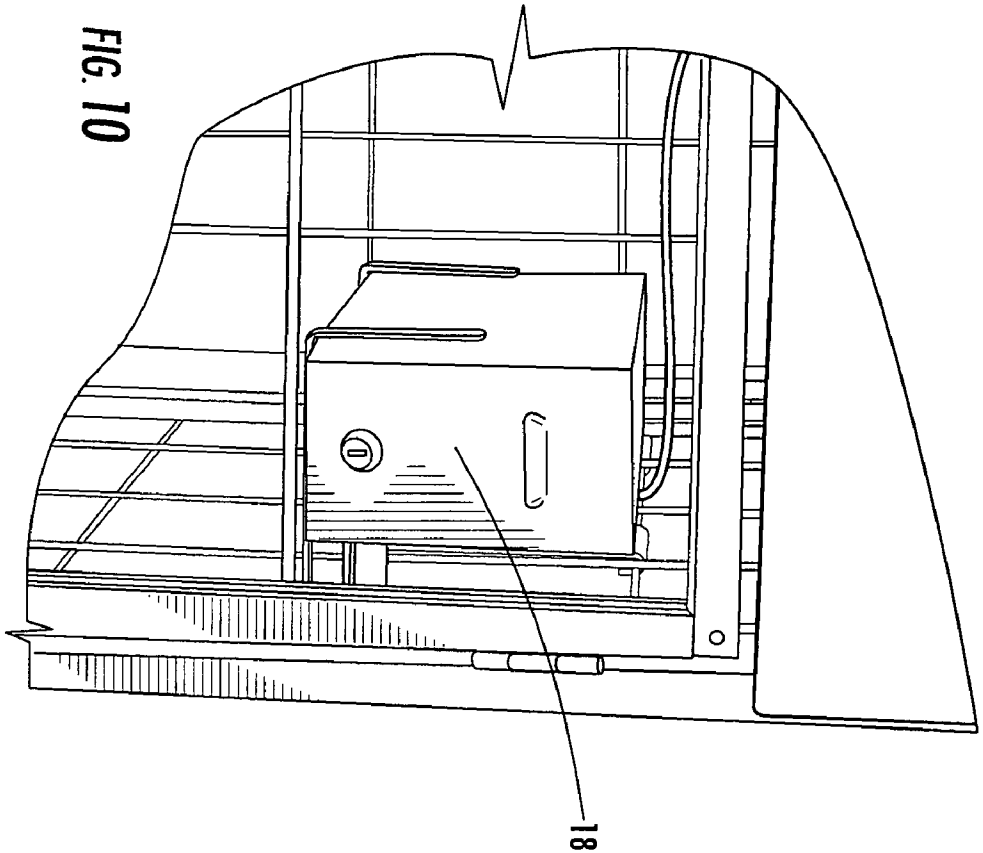
FIG. 10 is an cutaway elevation view of the receipt dispenser of the bottle return apparatus of FIG. 2.

As depicted in FIGS. 1, 5 and 10, the sensor 17 is operatively connected to a receipt dispenser 18, which dispenses a receipt when an empty bottle 16 is deposited in the apparatus 10. As those in the art will appreciate, there are many methods of providing such operative connectivity, including, but not limited to, electrical wiring, mechanical cabling, optical coupling, radio coupling, and the like. When the sensor 17 detects the presence of a bottle entering the bin 11, the sensor 17 activates the receipt dispenser 18, which generates a receipt 19. The receipt dispenser 18 may be a printer that prints a receipt 19 upon being activated by the sensor 17. Alternatively, the receipt dispenser 18 may be a device that dispenses preprinted receipts upon being activated by the sensor 17.

As those in the art will appreciate, there are many receipt dispensers that are suitable for use with the present invention. One such receipt dispenser that may be advantageously used in the present invention is a ticket dispenser, such as the ticket dispenser manufactured by Deltronic Labs, Inc. and designated a model number DL-4-SS.

An RFID printer or other device capable of encoding information onto an RFID tag may also be advantageously used as the receipt dispenser 18.

Figure 9:
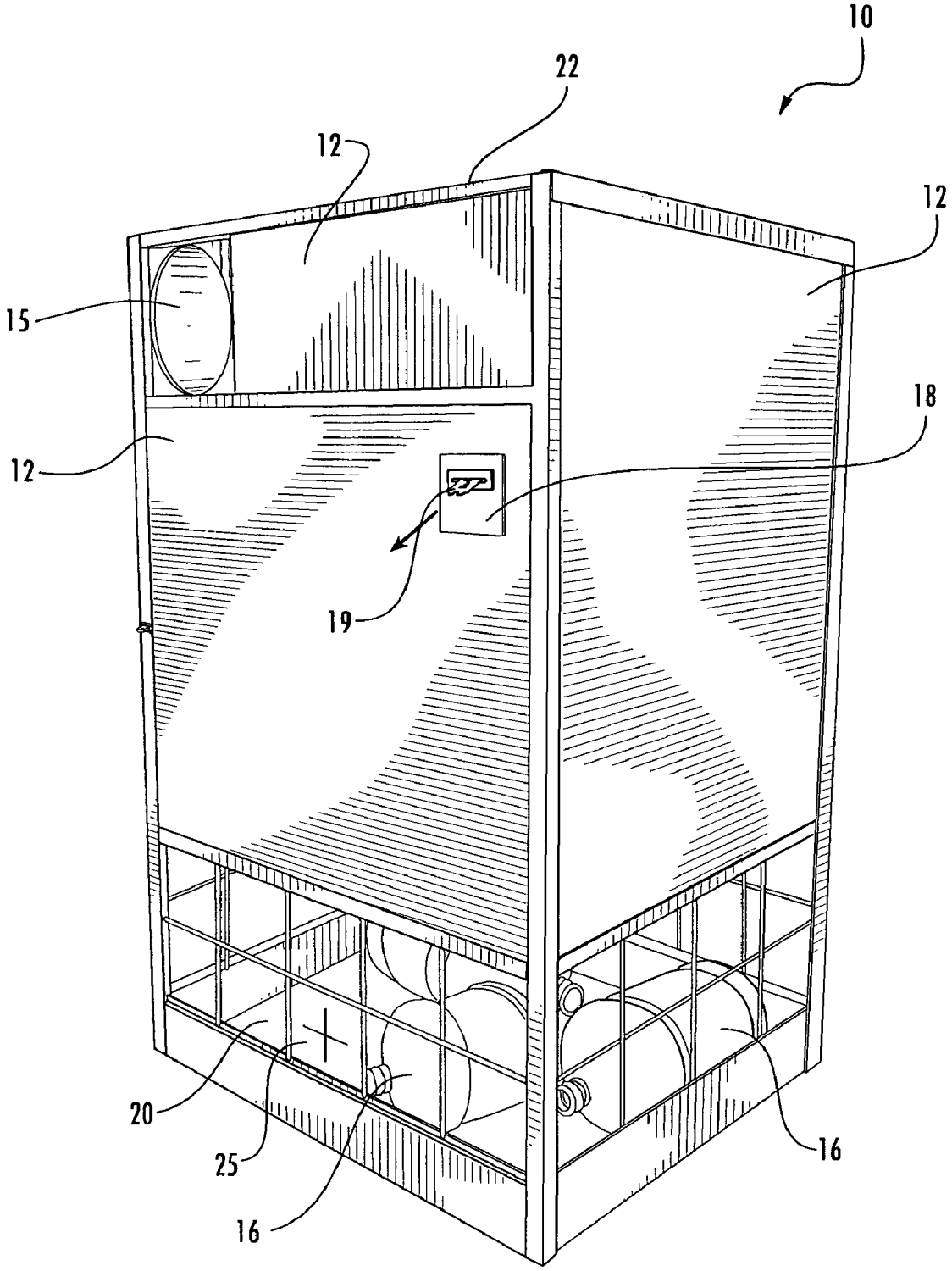
FIG. 9 is a perspective view of the bottle return apparatus of FIG. 2 illustrating a receipt dispenser dispensing a receipt.
Figure 12:
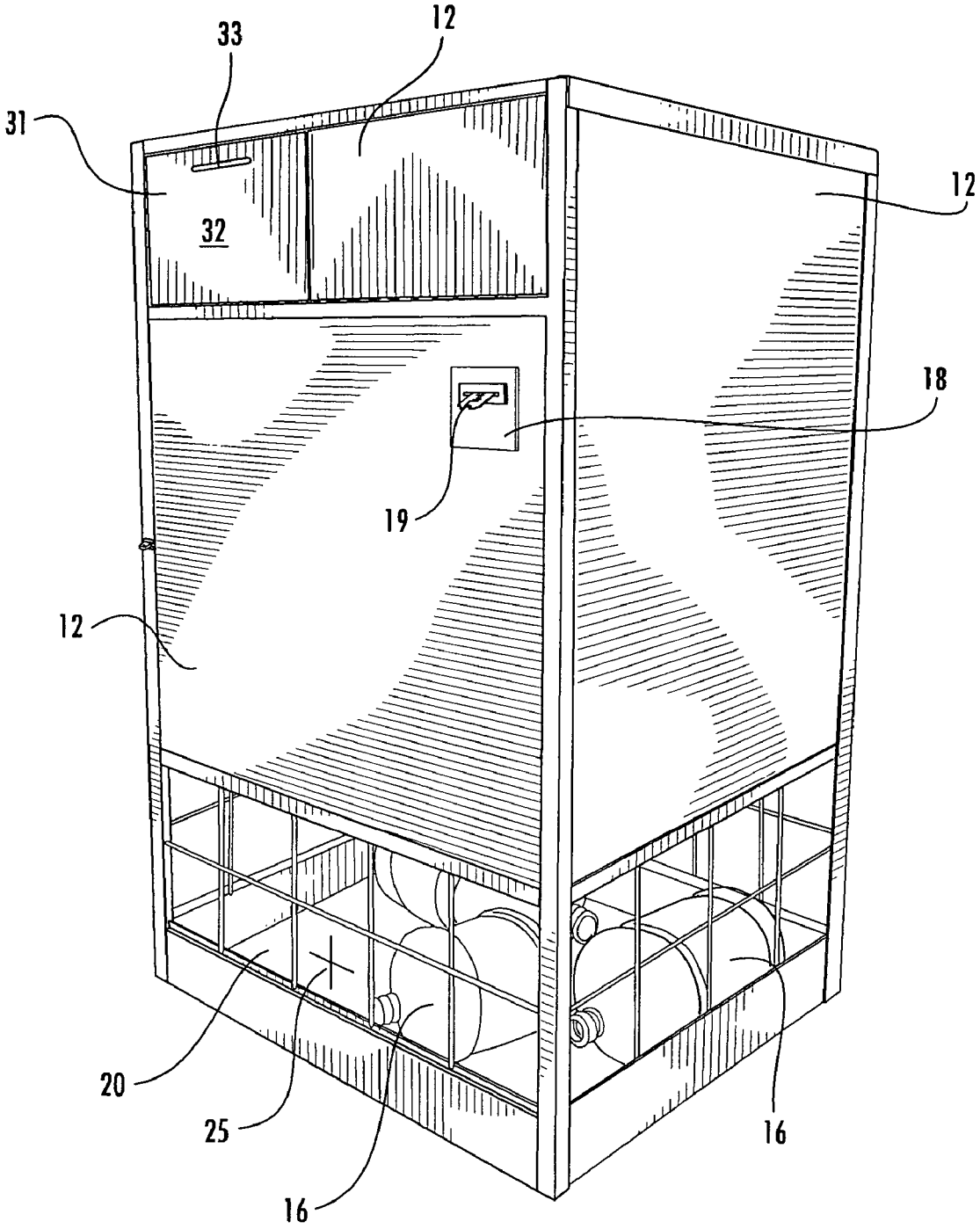
FIG. 12 is a perspective view of a preferred embodiment of a bottle return apparatus in accordance with the present invention.
Figure 16:
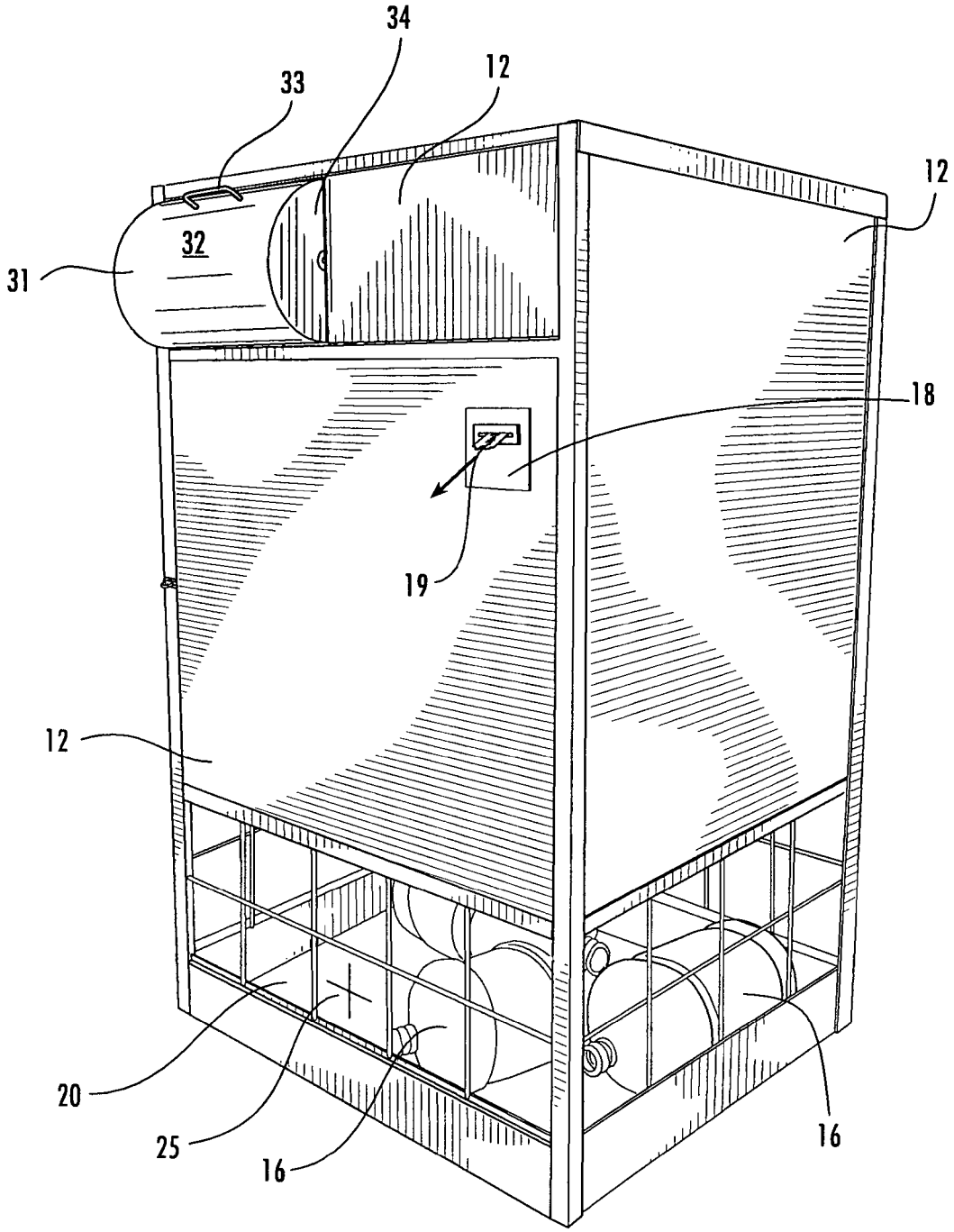
FIG. 16 is a perspective view of a preferred embodiment of a bottle return apparatus in accordance with the present invention.

As illustrated in FIGS. 9, 12 and 16, after a receipt is dispensed by the receipt dispenser 18, a customer having deposited an empty bottle in the apparatus may remove the receipt 19 from the apparatus 10.

Figure 11:
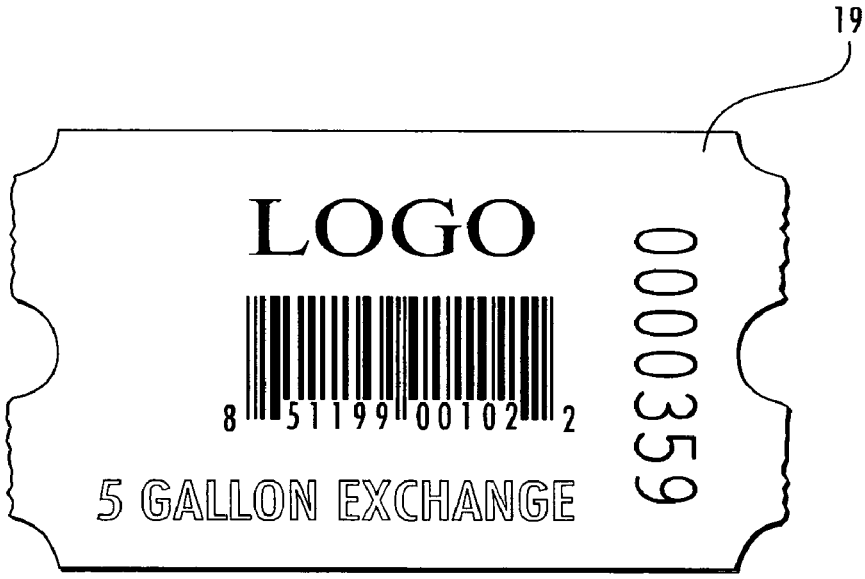
FIG. 11 is a plan view of a receipt having a universal product code disposed thereon.

FIG. 11 illustrates a receipt that may advantageously be used with the present invention. This receipt 19 has product identification indicia that corresponds to the drinking water bottles of the type with which use of the apparatus is intended. The product identification indicia may, for example, include a Universal Product Code ("UPC"), or a Stock Keeping Unit ("SKU") number, or any other indicia used to identify the bottled water product.

The receipt 19 may include an RFID device, such as an RFID tag or so-called "smart label" that contains product identification indicia. RFID-capable receipts may have product identification indicia pre-encoded on RFID tags on the receipts or, if the receipt dispenser is an RFID printer or other device capable of encoding information onto an RFID tag, the receipts may include RFID tags that are encoded with product identification indicia by the receipt dispenser 18.

Product identification indicia may be on one or both sides of the receipt 19. If two sizes of water bottles, 3-gallon and 5-gallon sizes for example, are sold by a particular retailer, the receipt 19 may have product identification indicia corresponding to the 3-gallon size on one side and product identification indicia corresponding to the 5-gallon size on the other side. In this way a customer depositing either the three gallon size or the five gallon size in the apparatus receives a corresponding receipt without the necessity of the apparatus determining which size of bottle has been deposited.

If an RFID reader is used as the sensor 17 and an RFID printer used as the receipt dispenser 18, the receipt 19 may be encoded with RFID product identification indicia corresponding to the size of water bottle associated with the RFID tag that is detected by the sensor when a bottle having an RFID tag enters the apparatus.

Because "empty" beverage bottles often still contain moisture, it is desirable to facilitate air flow around empty water bottles that have been deposited in the bin 11 to help remove moisture from the apparatus 10, dry the empty bottles 16 and provide some deterrence against insect infestation while the bottles 16 are stored in the bin awaiting pick-up and reuse. One or more circulation openings 25 are provided to allow air from the exterior of the bin 11 to pass into the interior of the bin 11 where empty bottles 16 are contained.

Circulation openings 25 may be any desired shape or size. In determining the number, shape and size of circulation openings, consideration should be given to the size of bottles with which the apparatus is intended to be used and the size and number of circulation openings required to facilitate the desire air flow through the apparatus.

In a preferred embodiment, a plurality of circulation openings 25 are provided, each such circulation opening 25 having an area less than the area of the opening of the receiving chute 15. In this way, when the receiving chute 15 is configured to permit only one empty bottle at a time to pass there through, the circulation openings 25 prevent empty bottles 16 from being removed from the bin 11 through the circulation openings 25.

Means for receiving a bottle of predetermined size from outside of the bin 11 into the interior space of the bin other than a receiving chute 15 are also within the scope of the present invention. For example, FIGS. 12-15 and FIGS. 16-18 illustrate preferred embodiments of the present invention in which a receiving tray 31 that rotates around an axis A between an open position and a closed position is used instead of a receiving chute 15.

Figure 13:
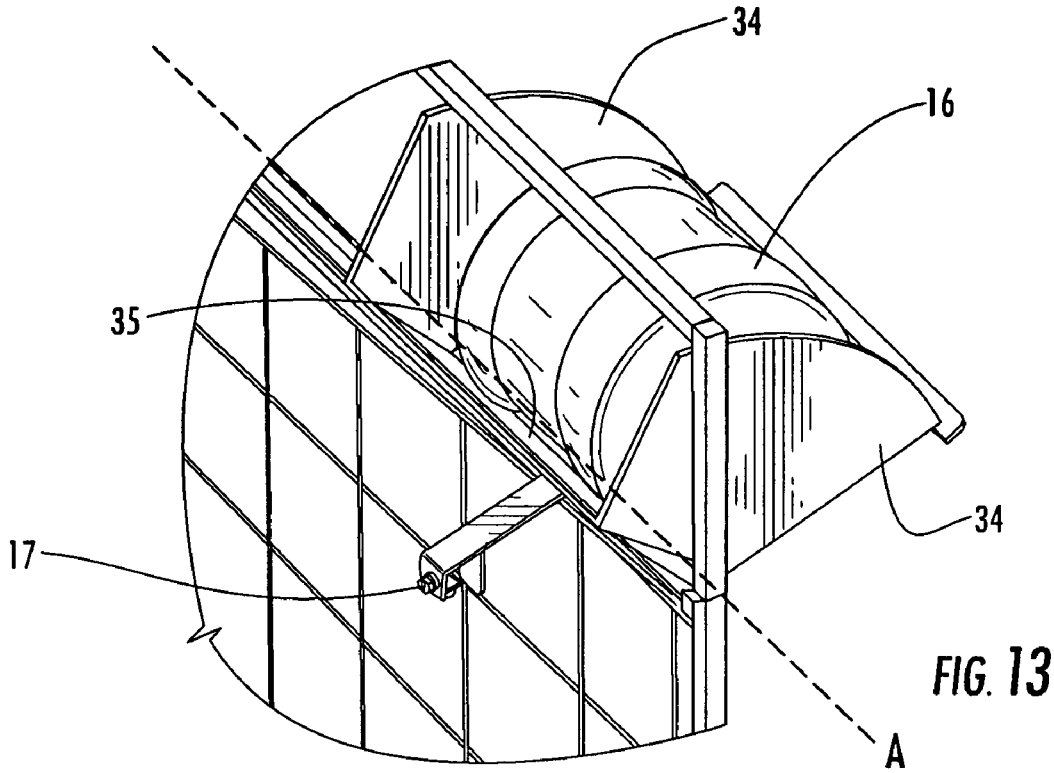
FIGS. 13 and 14 are cutaway perspective views illustrating the receipt of an empty bottle into the apparatus illustrated in FIG. 12 and the detection of the empty bottle by the sensor.
Figure 14:
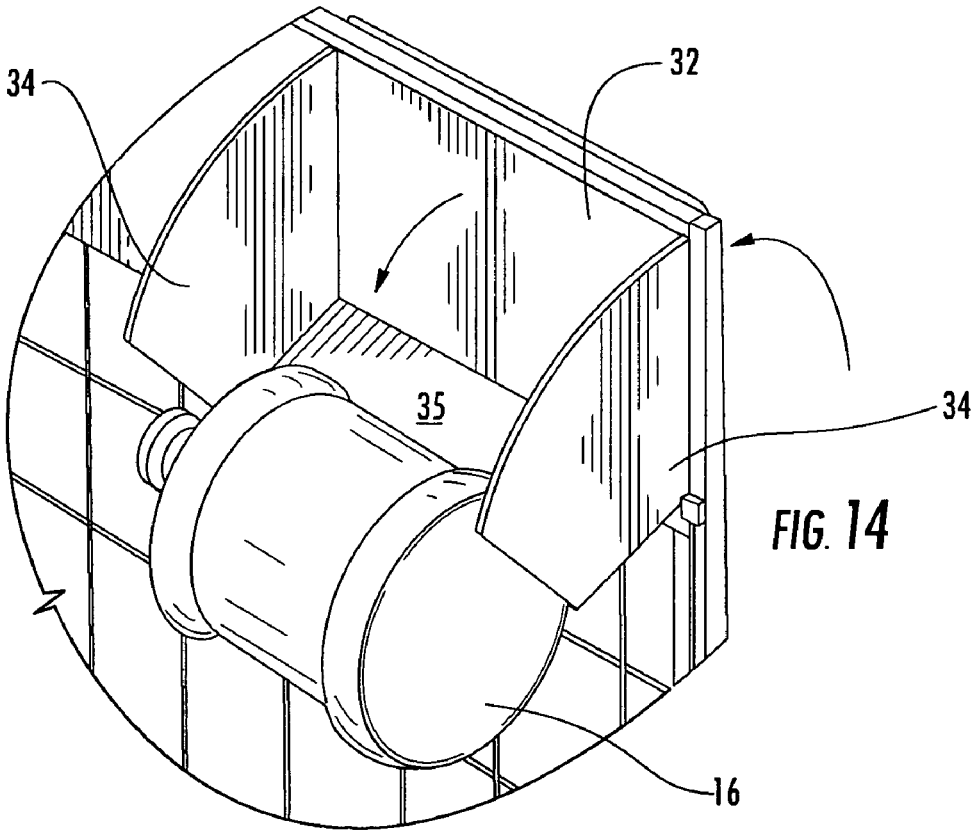

In a preferred embodiment illustrated in FIGS. 12-15, the exterior tray wall 32 of the receiving tray 31 when in the closed position is generally flat and may be flush with an exterior surface of a wall 21 of the apparatus 10. A handle 33 extends outwardly from the exterior tray wall 32. As illustrated in FIGS. 13 and 14, the receiving tray 31 in this preferred embodiment has two tray side walls 34 and an interior tray wall 35. The receiving tray 31 of this preferred embodiment is attached to the bin 11 is such a way that the receiving tray 31 rotates about an axis A that runs generally along the line formed by the joint between the exterior tray wall 32 and the interior tray wall 35. A hinge may be used to attach the receiving tray 31 to the bin 11 and thereby create this rotating motion.

To deposit an empty bottle 16 into the bin 11 in this preferred embodiment, the receiving tray 31 is pulled using the handle 33 to the open position (illustrated in FIG. 13), a bottle is placed in the receiving tray 31, and the receiving tray 31 is returned to the closed position (illustrated in FIGS. 12 and 14), whereupon the bottle 16 falls into the bin 11 by gravity (illustrated in FIG. 14). A spring mechanism or other known device may be used to bias the receiving tray 31 in the closed position.

Figure 15:
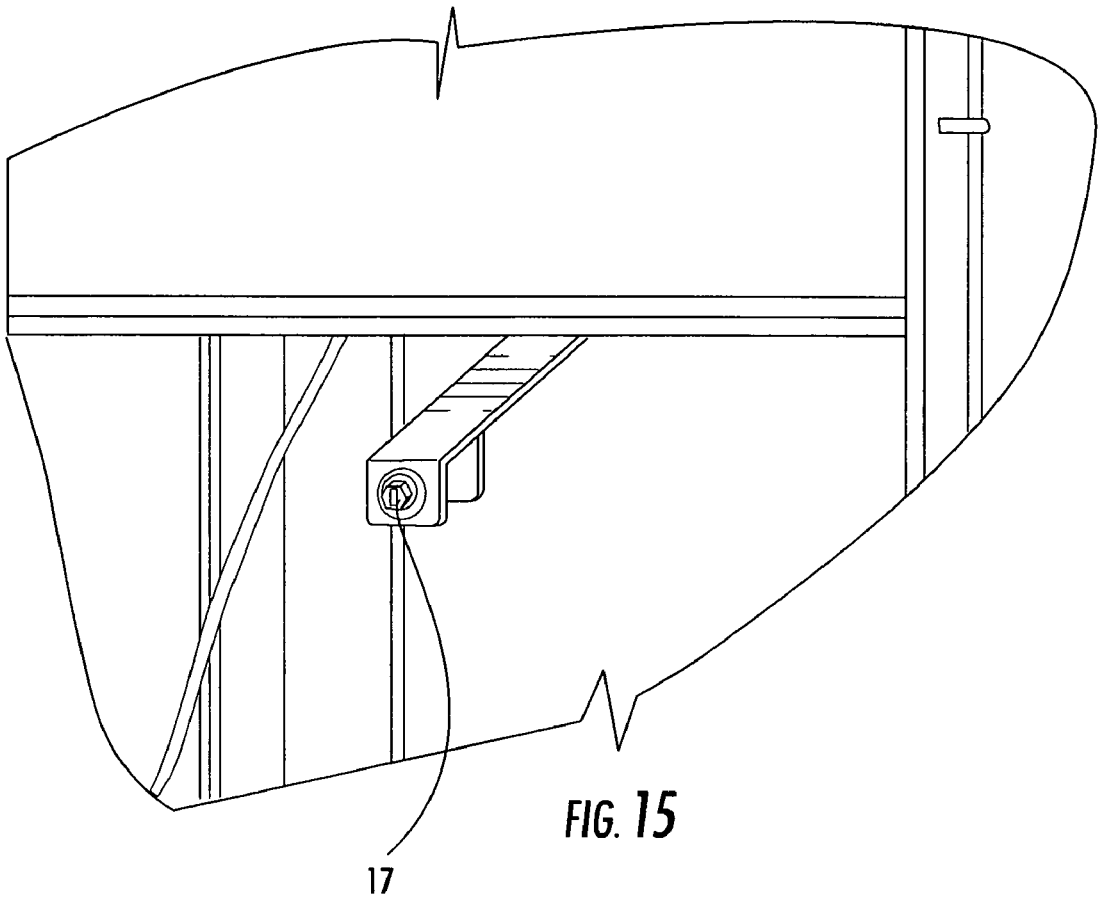
FIG. 15 is a cutaway perspective view of a sensor of the bottle return apparatus illustrated in FIG. 12.

As illustrated in FIGS. 13 and 15, the sensor 17 in this preferred embodiment may advantageously be positioned in the bin 11 under the receiving tray 31 so as to detect a bottle 16 falling from the receiving tray 31 into the bin 11.

Figure 17:
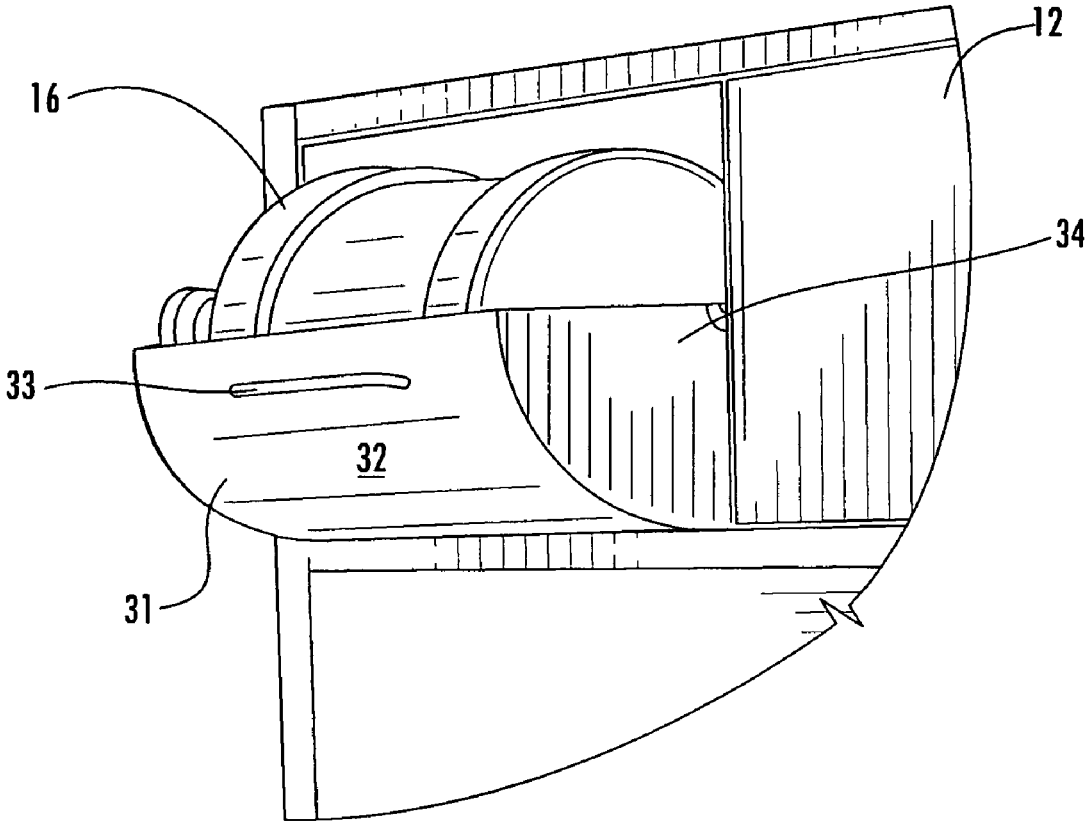
FIGS. 17 and 18 are perspective views illustrating the receipt of an empty bottle into the apparatus illustrated in FIG. 16 and the detection of the empty bottle by the sensor.
Figure 18:
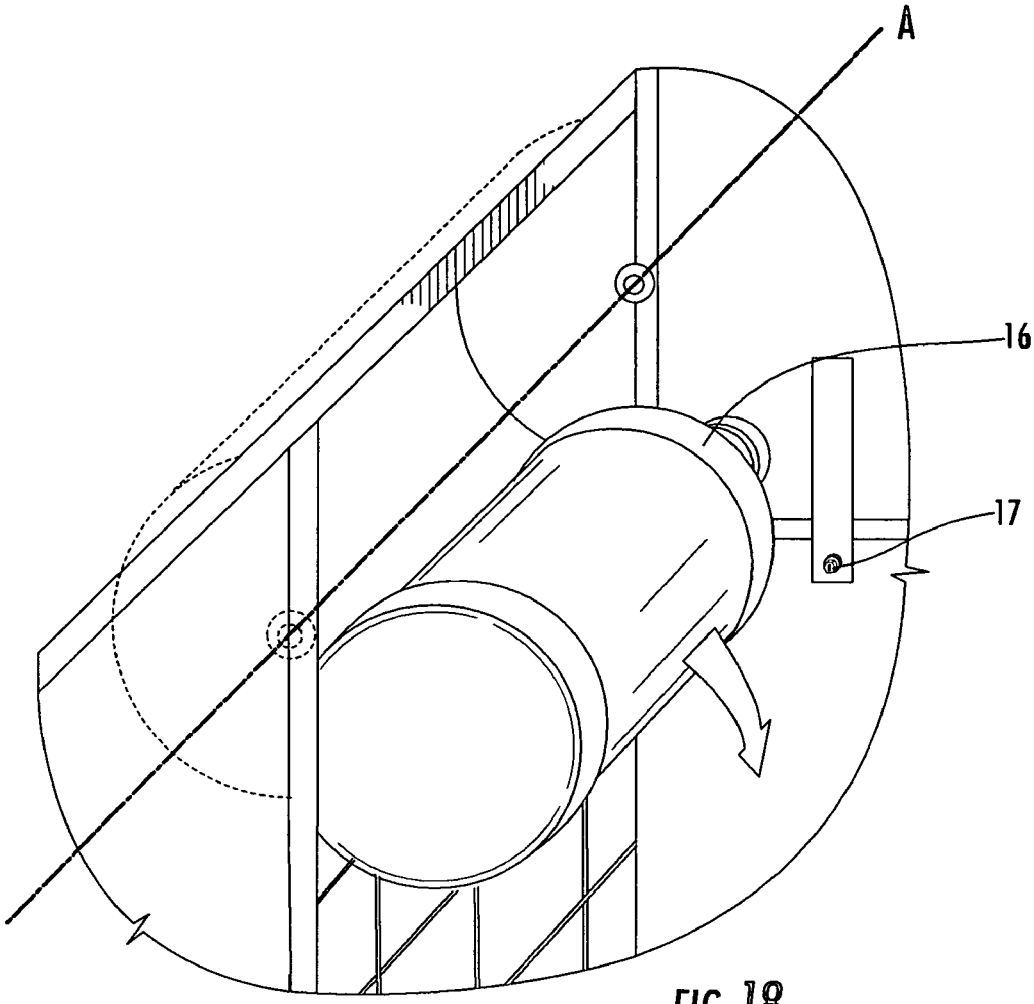

In a preferred embodiment illustrated in FIGS. 16-18, the exterior tray wall 32 of the receiving tray 31 is arcuate and each tray side wall 34 is semicircular. As illustrated in FIG. 16, in the closed position the arcuate exterior tray wall 32 in this preferred embodiment extends outwardly from the wall 21 of the apparatus. A handle 33 extends outwardly from the exterior tray wall 32.

As illustrated in FIGS. 17 and 18, the receiving tray 31 in this preferred embodiment is attached to the bin 11 in such a way that the receiving tray 31 rotates about an axis A generally located along a line connecting the mid point of the straight edge of each semicircular tray side wall 34.

To deposit a bottle into the bin in this preferred embodiment, the receiving tray 31 is pulled using the handle 33 to the open position (illustrated in FIG. 17), a bottle is placed in the receiving tray 31, and the receiving tray 31 is returned to the closed position whereupon the bottle 16 falls into the bin 11 by gravity (illustrated in FIG. 18). When the receiving tray 31 is in the open position, a portion of the arcuate exterior tray wall 32 extends into the interior of the bin 11. A spring mechanism or other known device may be used to bias the receiving tray 31 in the closed position.

The sensor 17 in this preferred embodiment may be positioned in the bin 11 under the receiving tray 31 so as to detect a bottle falling from the receiving tray 31 into the bin 11, as previously described. Alternatively, and as illustrated in FIG. 18, the sensor 17 in this preferred embodiment may be positioned on the interior side of a wall 21 of the bin 11 so as to detect a bottle falling from the receiving tray 31 into the bin 11.

The door 13, receipt dispenser 18, one or more circulation openings 25 and means for receiving a bottle of predetermined size from outside of the bin may be arranged in any desired configuration in the apparatus 10. In a preferred embodiment illustrated in FIGS. 1 and 2, each is arranged on the same side of the apparatus 10 in order to permit positioning of the apparatus 10 in a location where only one side of the apparatus 10 is accessible. Additionally, the means for receiving a bottle of predetermined size from outside of the bin may, but need not necessarily, be positioned higher in the vertical direction than the receipt dispenser 18. The receipt dispenser 18 is preferably positioned at a height that permits customers to easily remove the receipt 19 after being dispensed. The receipt dispenser 18 and the door 13 may further be positioned such that each is aligned with the other in a generally coplanar relationship on the apparatus.

The apparatus of the present invention thus eliminates the problematic need for a store employee to be present when a customer returns an empty bottle in order to verify the return, receive the empty bottle and store it. Using the apparatus of the present invention, a customer simply deposits an empty water bottle 16 into the bin 11, whereby the sensor 17 detects entry of the bottle into the bin and activates the receipt dispenser 18 to dispense a receipt 19 for the deposited bottle. The receipt 19 has product identification indicia thereon that corresponds to a full drinking water bottle. The customer may then take the receipt 19 from the apparatus and present the receipt to the store cashier when purchasing a full bottle of drinking water. In this way, the receipt 19 can serve both as evidence of bottle return and as a "price tag" that can be entered, scanned or read if a purchaser who returns an empty bottle desires to buy a new full water bottle.

Figure 19:
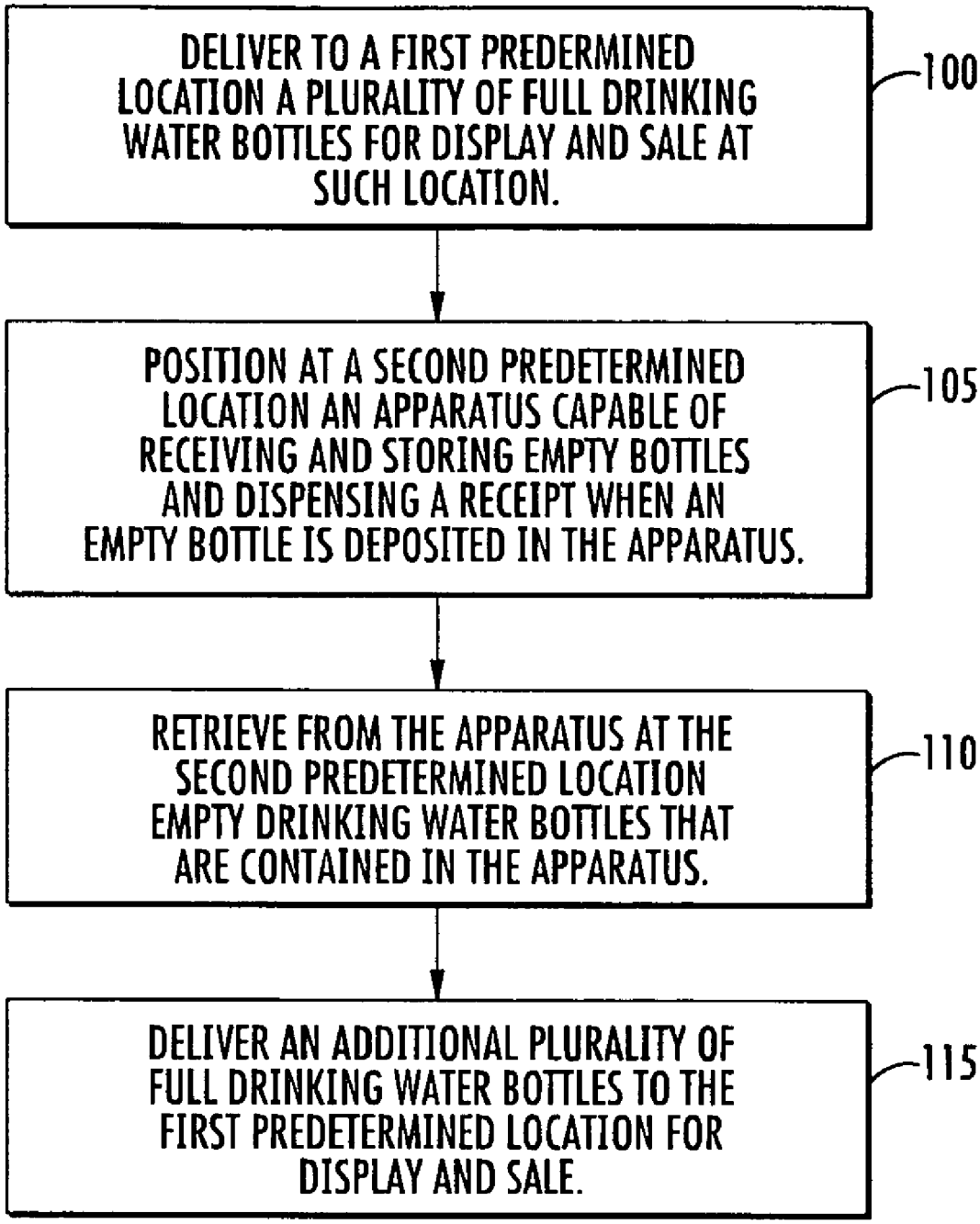
FIG. 19 is a schematic illustration of a bottled water distributing method of the present invention.

The apparatus of the present invention may be advantageously utilized in the bottled water distributing and selling methods of the present invention. A preferred embodiment of bottled water distributing method according to the present invention is schematically illustrated in FIG. 19.

As represented by reference numeral 100, at a predetermined time a bottled water distributor delivers to a first predetermined location a plurality of full drinking water bottles for display and sale at such location. The first predetermined location may advantageously be a store or other establishment where goods or services are sold. Typically, full drinking water bottles are displayed on a rack, shelf or pallet. Customers desiring to purchase a full drinking water bottle simply remove a full bottle from the rack, shelf or pallet and proceed to the check out station.

As represented by reference numeral 105, the distributor positions at a second predetermined location an apparatus that can receive and store empty bottles and dispense a receipt for each empty bottle deposited in the apparatus. The receipt has product identification indicia thereon. The second predetermined location may advantageously be the same store or establishment as the first predetermined location. Also advantageously, full drinking water bottles may be displayed inside of such store and the return apparatus may be placed outside of such store. This allows customers returning an empty drinking water bottle to deposit the empty drinking water bottle in the apparatus outside of the store and then enter the store and purchase a full drinking water bottle.

As represented by reference numeral 110, after the time at which the distributor delivers the full drinking water bottles to the location, the distributor retrieves from the apparatus at the second predetermined location any empty drinking water bottles contained in the apparatus and, as represented by reference numeral 115, delivers an additional plurality of full drinking water bottles to the first predetermined location for display and sale.

There are at least two accounting arrangements between the distributor an the store operator that may be advantageously employed with the methods of the present invention. In the so-called "consignment model," the distributor owns the bottled water inventory at a retailer's stores. The retailer has possession of the inventory of full water bottles and is allowed to sell the inventory. Periodically, the retailer "settles up" with the distributor for the bottles sold and, if the retailer accepts empty bottle returns, for the empty bottles returned to the retailer location. The main advantage of the consignment model for the retailer is that the retailer does not have to tie up its capital in the drinking water inventory and thus the distributor, and not the retailer, bears the risk of poor product sales.

A second model that may advantageously used with the present invention is the so-called "inventory model." In this model, a retailer purchases full drinking water bottles from a distributor and thus the retailer owns the inventory in its store locations. Typically, distributors in the inventory model invoice retailers upon or soon after delivery of the bottled water inventory to the retailer.

These two models are illustrated in the following examples. In each example, it is assumed that the bottled water distributor charges the retailer $10 for each full water bottle delivered, but gives the retailer a cost reduction of $5 for each empty water bottle returned.

In the consignment model, a distributor initially delivers 20 full water bottles. At this point, the retailer does not owe the distributor because the bottles have been accepted on consignment. Subsequently, the distributor returns to the retailer's store and finds that 5 bottles have been sold but no empty bottles have been returned. The retailer owes the distributor $50. The distributor then leaves 5 new full water bottles to replenish the store's inventory. Subsequently, the distributor returns to the store and finds that 5 more bottles have been sold and 3 empty bottles have been returned to the store. The retailer owes the distributor $35. The distributor leaves 5 new full bottles to replenish the inventory of bottles at the store. The distributor also retains the 3 empty bottles for reuse. Subsequently, the distributor returns to the store and finds that 5 bottles have been sold and 10 empty bottles have been returned to the store. The retailer does not owe the distributor because the amount that would have been owed for the 5 full bottles is equally offset by the value of the 10 empty bottles. The distributor leaves 5 new full bottles to replenish the inventory of bottles at the store. The distributor also retains the 10 empty bottles for reuse. Subsequently, the distributor returns to the store and finds that 2 bottles have been sold and 10 empty bottles have been returned to the store. The distributor thus owes the retailer $30 because the cost reductions associated with the returned bottles exceed the cost of the replacement full bottles. Often in such circumstances the distributor will not actually pay the retailer but will instead maintain $30 as a balance on the retailer's account. The distributor leaves 2 new full bottles to replenish the inventory of bottles at the store. The distributor also retains the 10 empty bottles for reuse.

In the inventory model, a distributor initially delivers 20 full water bottles. At this point, the retailer owes the distributor $200. Subsequently, the distributor returns to the retailer's store and finds that 5 bottles have been sold but no empty bottles have been returned. The distributor leaves 5 new full water bottles to replenish the store's inventory and the retailer owes the distributor $50. Subsequently, the distributor returns to the store and finds that 5 bottles have been sold and 3 empty bottles have been returned to the store. The retailer owes the distributor $35. The distributor leaves 5 new full bottles to replenish the inventory of bottles at the store. The distributor also retains the 3 empty bottles for reuse. Subsequently, the distributor returns to the store and finds that 5 bottles have been sold and 10 empty bottles have been returned to the store. The retailer does not owe the distributor because the amount that would have been owed for the 5 full bottles is equally offset by the value of the 10 empty bottles. The distributor leaves 5 new full bottles to replenish the inventory of bottles at the store. The distributor also retains the 10 empty bottles for reuse. Subsequently, the distributor returns to the store and finds that 2 bottles have been sold and 10 empty bottles have been returned to the store. The distributor thus owes the retailer $30 because the cost reductions associated with the returned bottles exceed the cost of the replacement full bottles. Often in such circumstances the distributor will not actually pay the retailer but will instead maintain a balance of $30 on the retailer's account. The distributor leaves 2 new full bottles to replenish the inventory of bottles at the store. The distributor also retains the 10 empty bottles for reuse.

Figure 20:
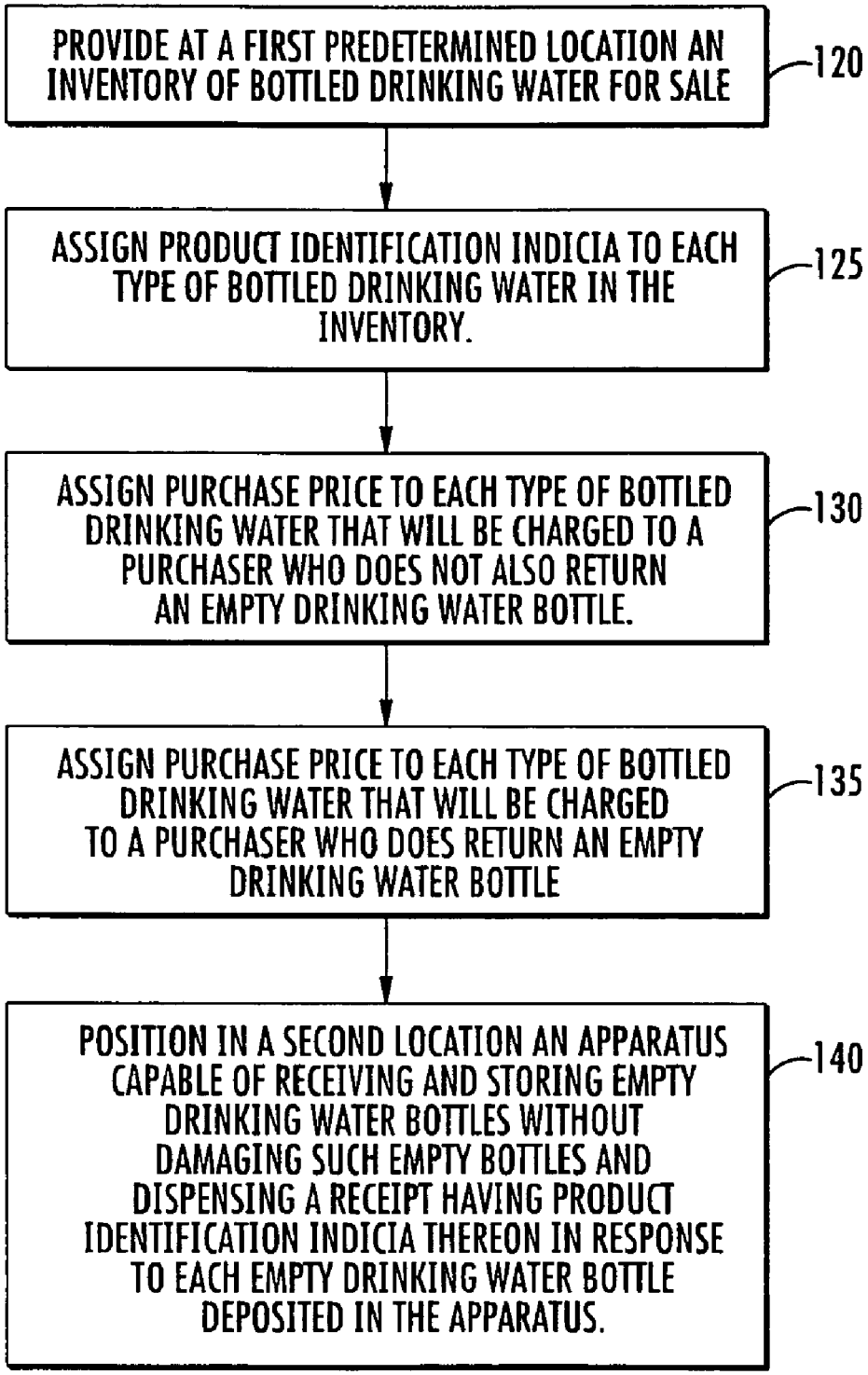
FIG. 20 is a schematic illustration of a bottled water selling method of the present invention.

FIG. 20 schematically illustrates a preferred embodiment of a method of selling bottled drinking water in accordance with the present invention. As represented by reference numeral 120, a seller provides at a first predetermined location an inventory of bottled drinking water for sale. As represented by reference numeral 125, product identification indicia is assigned to each type of bottled drinking water in the inventory. As represented by reference numeral 130, for each type of bottled drinking water in the inventory a purchase price is assigned that will be charged to a purchaser who does not also return an empty drinking water bottle of the same type. As represented by reference numeral 135, for each type of bottled drinking water in the inventory a purchase price is assigned that will be charged to a purchaser who does return an empty drinking water bottle of the same type. As represented by reference numeral 140, an apparatus is positioned in a second location that can receive and store each type of drinking water bottle in the inventory, without damaging the empty bottles, and dispense for each bottled deposited in the apparatus a receipt having assigned product identification indicia.

Advantageously, the first predetermined location at which the inventory of drinking water bottles is provided for sale can be a store that also sells water cooler devices compatible with drinking water bottles in the inventory.

As shown by the discussion above, the apparatus and methods of the present invention solve the problems associated with previous drinking water distribution systems by providing an apparatus that can receive, store and evidence receipt of an empty drinking water bottle without use of store employees and providing distribution and selling methods in which deposits are not managed by retailers and retailers are not forced to carry deposit amounts on the retailers' financial books.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A drinking water bottle return apparatus comprising:

a bin having a bottom, a plurality of walls defining an interior space capable of holding a plurality of drinking water bottles of predetermined size and at least one door that is movable between a closed position and an open position that allows access to the interior space for removal of drinking water bottles of predetermined size from the interior space;

at least two circulation openings in the plurality of walls in said bin allowing direct communication therethrough between air in the interior space of said bin and air outside of the apparatus, a receiving chute through which a drinking water bottle of predetermined size can pass from outside of the apparatus into the interior space of said bin, said receiving chute being adapted and positioned such that when the bin is empty a bottle of predetermined size completing travel through said receiving chute falls by gravity directly into the bin without obstruction and intact until stopped by the bottom of said bin, whereat the empty bottle of predetermined size remains intact in said bin;

a sensor adapted and positioned to detect a drinking water bottle of predetermined size received into the interior space of said bin; and a receipt dispenser operatively connected to said sensor for dispensing a receipt in response to the detection by said sensor of a drinking water bottle of predetermined size received into the interior space of said bin, wherein an empty drinking water bottle of predetermined size received from outside of the apparatus into the interior space of said bin when said bin is empty falls by gravity without obstruction and intact until stopped by the bottom of said bin and is detected by said sensor, which causes said receipt dispenser to dispense a receipt for the drinking water bottle of predetermined size.

2. A drinking water bottle return apparatus as defined in claim 1 wherein the receiving chute is of a size and shape that not more than one of the drinking water bottles of predetermined size can pass simultaneously there through.

3. A drinking water bottle return apparatus as defined in claim 1 wherein the receiving chute is generally cylindrical.

4. A drinking water bottle return apparatus as defined in claim 3 wherein each drinking water bottle of predetermined size in the plurality of drinking water bottles of predetermined size has a diameter and a length and wherein the diameter of the generally cylindrical receiving chute is greater than the diameter of the drinking water bottle of predetermined size and less than the length of the drinking water bottle of predetermined size.

5. A drinking water bottle return apparatus as defined in claim 1, wherein the length of the receiving chute is at least ⅓ the length of the drinking water bottle of predetermined size.

6. A drinking water bottle return apparatus as defined in claim 1 further comprising a closure flap movable between a closed position preventing passage of a drinking water bottle of predetermined size through the receiving chute and an open position allowing passage of a drinking water bottle of predetermined size through the receiving chute.

7. A bottle return apparatus as defined in claim 3 wherein the diameter of the generally cylindrical receiving chute is less than the length of the bottle of predetermined size.

8. A drinking water bottle return apparatus as defined in claim 3 wherein the diameter of said generally cylindrical receiving chute is at least ten inches.

9. A bottle return apparatus as defined in claim 1 wherein the area defined by at least one circulation opening of the at least two circulation openings is less than the area defined by the receiving chute.

10. A drinking water bottle return apparatus as defined in claim 1 wherein at least a portion of said receiving chute extends into the interior space of said bin.

11. A drinking water bottle return apparatus as defined in claim 1 wherein said sensor is adapted and positioned to detect a drinking water bottle of predetermined size passing through said receiving chute from outside of said bin into the interior space of said bin.

12. A drinking water bottle return apparatus as defined in claim 1 wherein said sensor is adapted and positioned to detect a drinking water bottle of predetermined size as the drinking water bottle of predetermined size falls by gravity in the interior space of said bin after having passed completely through said receiving chute.

13. A drinking water bottle return apparatus as defined in claim 1 wherein said sensor is a mechanical sensor.

14. A drinking water bottle return apparatus as defined in claim 1 wherein said sensor is an electro optical sensor.

15. A drinking water bottle return apparatus as defined in claim 1 wherein said sensor is a device capable of detecting the presence of an RFID tag.

16. A drinking water bottle return apparatus as defined in claim 1 wherein said bin comprises four generally rectangular vertically extending side walls, a generally rectangular top and a generally rectangular bottom.

17. A drinking water bottle return apparatus as defined in claim comprising two opposing doors in a so-called French door configuration.

18. A drinking water bottle return apparatus as defined in claim 1 wherein said receipt dispenser dispenses receipts imprinted with a universal product code corresponding to a full drinking water bottle of the type of drinking water bottle received into the interior space of said bin.

19. A drinking water bottle return apparatus as defined in claim 1 wherein said receipt dispenser is a device capable of encoding information onto an RFID tag.

20. A drinking water bottle return apparatus as defined in claim 1 wherein said receipt dispenser dispenses receipts having product identification indicia thereon corresponding to drinking water bottles deposited in the apparatus.

21. A drinking water bottle return apparatus as defined in claim 20 wherein said receipt dispenser dispenses receipts having product identification indicia on each side thereof.

22. A drinking water bottle return apparatus as defined in claim 20 wherein said receipt dispenser dispenses receipts having an RFID tag.

23. A drinking water bottle return apparatus as defined in claim 1 wherein said receipt dispenser is also a printer.

24. A drinking water bottle return apparatus as defined in claim 1 wherein said receiving chute is positioned higher in the vertical direction than said receipt dispenser.

25. A drinking water bottle return apparatus as defined in claim 1 wherein said at least one door, said receipt dispenser and said receiving chute are accessible from the same side of said bin.

26. A drinking water bottle return apparatus as defined in claim 1 wherein said at least one door, said receipt dispenser, said receiving chute and at least one circulation opening of said at least two circulation openings are accessible from the same side of said bin.

27. A drinking water bottle return apparatus as defined in claim 1 wherein the bottom of said bin is a surface upon which said bin rests.

28. A drinking water bottle return apparatus as defined in claim 1 wherein said at least one door of said bin is spaced from the bottom of said bin.

29. A drinking water bottle return apparatus as defined in claim 16 wherein said top and said side walls are comprised of a material that blocks at least a portion of ultraviolet light from the interior space of said bin.

30. A drinking water bottle return apparatus as defined in claim 16, wherein the apparatus is of a size and shape so as to allow transport thereof on a standard pallet.

31. A drinking water bottle return apparatus comprising:

a bin having a bottom, a plurality of walls defining an interior space capable of holding a plurality of drinking water bottles of predetermined size and at least one door that is movable between a closed position and an open position that allows access to the interior space for removal of drinking water bottles of predetermined size from the interior space;

at least two circulation openings in the plurality of walls in said bin allowing direct communication therethrough between air in the interior space of said bin and air outside of the apparatus;

a receiving tray rotatably mounted such that the receiving tray is movable about an axis between an open position in which a drinking water bottle of predetermined size can be placed in the receiving tray from outside of the apparatus but cannot enter into the interior space of said bin and a closed position in which a drinking water bottle of predetermined size placed in the receiving tray while in the open position falls by gravity into the interior space of said bin when the receiving tray is moved from the open position to the closed position, said receiving tray being adapted and positioned such that when the bin is empty a bottle of predetermined size falling by gravity into said bin when the receiving tray is moved from the open position to the closed position falls by gravity directly into the bin without obstruction and intact until stopped by the bottom of said bin, whereat the empty bottle of predetermined size remains intact in said bin;

a sensor adapted and positioned to detect a drinking water bottle of predetermined size received into the interior space of said bin; and a receipt dispenser operatively connected to said sensor for dispensing a receipt in response to the detection by said sensor of a drinking water bottle of predetermined size received into the interior space of said bin, wherein an empty drinking water bottle of predetermined size received from outside of the apparatus into the interior space of said bin when said bin is empty falls by gravity without obstruction and intact until stopped by the bottom of said bin and is detected by said sensor, which causes said receipt dispenser to dispense a receipt for the drinking water bottle of predetermined size.

32. A drinking water bottle return apparatus as defined in claim 31 wherein said sensor is adapted and positioned to detect a drinking water bottle of predetermined size as the drinking water bottle of predetermined size falls by gravity in the interior space of said bin after having fallen from said receiving tray.

33. A drinking water bottle return apparatus as defined in claim 31 wherein said sensor is a mechanical sensor.

34. A drinking water bottle return apparatus as defined in claim 31 wherein said sensor is an electro optical sensor.

35. A drinking water bottle return apparatus as defined in claim 31 wherein said sensor is a device capable of detecting the presence of an RFID tag.

36. A drinking water bottle return apparatus as defined in claim 31 wherein said bin comprises four generally rectangular vertically extending side walls, a generally rectangular top and a generally rectangular bottom.

37. A drinking water bottle return apparatus as defined in claim 31 comprising two opposing doors in a so-called French door configuration.

38. A drinking water bottle return apparatus as defined in claim 31 wherein said receipt dispenser dispenses receipts imprinted with a universal product code corresponding to a full drinking water bottle of the type of drinking water bottle received into the interior space of said bin.

39. A drinking water bottle return apparatus as defined in claim 31 wherein said receipt dispenser is a device capable of encoding information onto an RFID tag.

40. A drinking water bottle return apparatus as defined in claim 31 wherein said receipt dispenser dispenses receipts having product identification indicia thereon corresponding to drinking water bottles deposited in the apparatus.

41. A drinking water bottle return apparatus as defined in claim 40 wherein said receipt dispenser dispenses receipts having product identification indicia on each side thereof.

42. A drinking water bottle return apparatus as defined in claim 40 wherein said receipt dispenser dispenses receipts having an RFID tag.

43. A drinking water bottle return apparatus as defined in claim 31 wherein said receipt dispenser is also a printer.

44. A drinking water bottle return apparatus as defined in claim 31 wherein said receiving tray is positioned higher in the vertical direction than said receipt dispenser.

45. A drinking water bottle return apparatus as defined in claim 31 wherein said at least one door, said receipt dispenser and said receiving tray are accessible from the same side of said bin.

46. A drinking water bottle return apparatus as defined in claim 31 wherein said at least one door, said receipt dispenser, said receiving tray and at least one circulation opening of said at least two circulation openings are accessible from the same side of said bin.

47. A drinking water bottle return apparatus as defined in claim 31, wherein the bottom of said bin is a surface upon which said bin rests.

48. A drinking water bottle return apparatus as defined in claim 31, wherein said at least one door of said bin is spaced from the bottom of said bin.

49. A drinking water bottle return apparatus as defined in claim 31 further comprising a locking mechanism of the at least one door.

50. A drinking water bottle return apparatus as defined in claim 36 wherein said top and said side walls are comprised of a material that blocks at least a portion of ultraviolet light from the interior space of said bin.

51. A drinking water bottle return apparatus as defined in claim 50, wherein the apparatus is of a size and shape so as to allow transport thereof on a standard pallet.

* * * * *